US008459406B1

(12) United States Patent
Dueck

(10) Patent No.: US 8,459,406 B1
(45) Date of Patent: Jun. 11, 2013

(54) MOUNTING APPARATUS FOR FIREARM SOUND SUPPRESSOR

(75) Inventor: Barry W. Dueck, Sunset Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/348,898

(22) Filed: Jan. 12, 2012

(51) Int. Cl.
*F41A 21/00* (2006.01)

(52) U.S. Cl.
USPC ..... 181/223; 89/14.4; 42/90

(58) Field of Classification Search
USPC ..... 181/223; 89/14.4; 42/90
See application file for complete search history.

(56) References Cited

U.S. PATENT DOCUMENTS

| | | | | |
|---|---|---|---|---|
| 4,576,083 | A | 3/1986 | Seberger, Jr. | |
| 5,092,223 | A | 3/1992 | Hudson | |
| 5,164,535 | A | 11/1992 | Leasure | |
| 5,356,183 | A * | 10/1994 | Cole | 285/305 |
| 5,433,133 | A | 7/1995 | La France | |
| 6,308,609 | B1 | 10/2001 | Davies | |
| 6,374,718 | B1 | 4/2002 | Rescigno et al. | |
| 6,412,389 | B2 * | 7/2002 | Fluhr | 89/14.4 |
| 6,450,079 | B1 * | 9/2002 | Bourdin et al. | 89/14.3 |
| 6,948,415 | B2 | 9/2005 | Matthews et al. | |
| 7,207,258 | B1 | 4/2007 | Scanlon | |
| 7,308,967 | B1 | 12/2007 | Hoel | |
| 7,412,917 | B2 | 8/2008 | Vais | |
| 7,594,464 | B2 | 9/2009 | Dueck | |
| 7,676,976 | B2 | 3/2010 | Dueck et al. | |
| 7,789,008 | B2 | 9/2010 | Petersen | |
| 7,832,323 | B1 | 11/2010 | Davies | |
| 7,856,914 | B2 | 12/2010 | Shults et al. | |
| 7,946,069 | B2 | 5/2011 | Dueck et al. | |
| D639,375 | S | 6/2011 | Oliver | |
| 7,987,944 | B1 | 8/2011 | Brittingham et al. | |
| 8,015,908 | B2 | 9/2011 | Kline et al. | |
| 8,030,603 | B2 * | 10/2011 | Schroeder | 244/3.24 |
| 8,087,338 | B1 | 1/2012 | Hines | |
| 8,100,224 | B1 | 1/2012 | Olson | |
| 8,167,084 | B1 | 5/2012 | Moore | |
| 2007/0095198 | A1 * | 5/2007 | Dater et al. | 89/14.2 |
| 2008/0084064 | A1 * | 4/2008 | Kerin et al. | 285/319 |
| 2011/0061966 | A1 | 3/2011 | Brittingham | |
| 2011/0132683 | A1 | 6/2011 | Miller et al. | |
| 2012/0152093 | A1 | 6/2012 | Koumbis | |
| 2012/0180352 | A1 * | 7/2012 | Addis | 42/1.06 |
| 2012/0199415 | A1 * | 8/2012 | Shults et al. | 181/223 |

OTHER PUBLICATIONS

U.S. Appl. No. 13/348,811, filed Jan. 12, 2012, inventors: Dueck et al.

(Continued)

*Primary Examiner* — Forrest M Phillips
(74) *Attorney, Agent, or Firm* — Haynes and Boone, LLP

(57) ABSTRACT

In one example, a method of aligning a firearm sound suppressor includes inserting a front portion of a body of an adapter into a socket of the firearm sound suppressor. The method also includes sliding a tab of the adapter into a slot disposed in an interior surface of the socket to rotationally align the firearm sound suppressor relative to a firearm. The method also includes contacting a plug of the adapter against the interior surface in a complimentary engagement. The plug is provided by a frusto-conical external surface of a rear portion of the body. The tab extends from the plug. Other embodiments are also contemplated.

16 Claims, 16 Drawing Sheets

OTHER PUBLICATIONS

U.S. Appl. No. 13/348,834, filed Jan. 12, 2012, inventor: Barry W. Dueck.
U.S. Appl. No. 13/348,870, filed Jan. 12, 2012, inventor: Barry W. Dueck.
U.S. Appl. No. 13/348,924, filed Jan. 12, 2012, inventors: Honigmann et al.
U.S. Appl. No. 29/410,783, filed Jan. 12, 2012, inventor: Barry W. Dueck.
U.S. Appl. No. 29/410,780, filed Jan. 12, 2012, inventor: Karl R. Honigmann.
U.S. Appl. No. 29/410,782, filed Jan. 12, 2012, inventor: Karl R. Honigmann.

* cited by examiner

MOUNTING APPARATUS FOR FIREARM SOUND SUPPRESSOR

BACKGROUND

1. Field of the Invention

This disclosure relates to firearms in general, and more particularly, to sound (e.g., noise) suppressors for firearms.

2. Related Art

Firearms, such as pistols or rifles, utilize expanding high-pressure gases generated by a burning propellant to expel a projectile from the weapon at a relatively high velocity. When the projectile, or bullet, exits the muzzle end of the weapon's barrel, a bright, "muzzle flash" of light and a high-pressure pulse of combustion gases accompany it. The rapid pressurization and subsequent depressurization caused by the high-pressure pulse gives rise to a loud sound known as "muzzle blast," which, like muzzle flash, can readily indicate to a remote enemy both the location of the weapon and the direction from which it is being fired. In some situations, such as covert military operations, it is highly desirable to conceal this information from the enemy by suppressing the flash and/or eliminating or substantially reducing the amplitude of the muzzle blast.

The use of sound suppressors (e.g., also referred to as noise suppressors and silencers) on firearms to reduce the amplitude of their muzzle blasts is known. Suppressors operate to reduce muzzle blast by reducing and controlling the energy level of the propellant gases accompanying the projectile as it leaves the muzzle end of the weapon. These devices typically include an elongated tubular housing containing a series of baffles that define a plurality of successive internal chambers. These chambers serve to control, delay, and divert the flow, expansion, and exiting of the propellant gases, and also to reduce their temperature, so as to achieve a corresponding reduction in the noise produced by the propellant gases as they ultimately exit the device. The rear (e.g., proximal) ends of these suppressors typically include a mechanism for removably attaching the device to the weapon, and their front (e.g., distal) ends include an opening for the exit of the projectile, and are typically located sufficiently forward of the muzzle end of the weapon that they also can effectively function as a flash hider (e.g., a muzzle flash suppressor).

In one classification scheme, silencers for firearms can be divided into two groups. In one group, the gases that follow the bullet into the rear end of the silencer are stored for a short period of time in each of a plurality of successive expansion chambers so as to produce a controlled expansion of the propellant gases through each chamber, thereby reducing their temperature and pressure in successive, gradual stages.

In a second group, at least a portion of the propellant gases are partially diverted through a plurality of radial vents or passages disposed between inner and outer circumferential walls of the suppressor to one or more un-baffled, radially exterior "blast suppressor" chambers located in a back section of the device, before being introduced into the series of expansion chambers of a baffled "front section" of the device of the type described above. Although this "two-stage" sound suppression technique is relatively more complex to implement, it provides more opportunities to delay and cool the propellant gases, and hence, to reduce muzzle blast sound levels overall.

Existing suppressors have certain problems that can mitigate their operation and/or efficiency. For example, as those of skill in the art will understand, since a suppressor operates by controllably containing the hot, expanding combustion gases used to propel the projectiles of the weapon upon which it is used, with extended use of the device over time, particulate contaminates contained in the combustion gases will condense and be deposited over the interior surfaces of the device, including the surfaces of the baffles. These deposits include carbon from the burnt propellant, lead from the projectiles, and in the case of the use of "jacketed" projectiles, copper, Teflon, and/or molybdenum disulfide. While these deposits can usually be cleaned away with suitable solvents, they are typically hard and adhesive in nature, making it difficult or impossible to disassemble the device for cleaning without damaging its parts.

Another problem associated with certain suppressors occurs where front and rear ends of a suppressor are both implemented using end caps that are secured to a housing with threaded joints. The rear end cap typically includes an internally threaded bore that is used to screw the suppressor onto an adapter, e.g., a flash hider, a muzzle brake, or directly onto a muzzle of the associated firearm to secure the suppressor thereto. Unfortunately, this arrangement can complicate the removal of the suppressor from the firearm because, as the suppressor is unscrewed from the adapter or the muzzle, the torque exerted by the user on the suppressor housing can cause the rear end cap of the suppressor to unscrew from the housing, rather than from the adapter or muzzle of the firearm. This may cause the rear end cap to remain substantially fixed on the adapter or muzzle. As a result, the suppressor may separate and become difficult to detach completely from the firearm.

Another problem that can occur particularly with the "two-stage" type of silencers described above relates to the fact that the first stage, "blast suppressor" back sections of the devices typically experience substantially greater radial pressures and temperatures than the baffled front compartments of the devices during the firing of a single round through the device. While this does not ordinarily present a problem when the weapon is fired intermittently, with sufficient time allowed between rounds to permit the pressure and temperature within the back section to abate, it can present a problem with sustained firing of the weapon at a relatively high rate of fire, e.g., during sustained, full automatic fire of the weapon. In such instances, it is possible for the outer tubular housing of the device to fail prematurely, i.e., to "blow out," due to the sustained local pressures and temperatures impinging directly thereon during such sustained, full automatic, high rates of fire. One unsatisfactory approach to solving this problem is to increase the overall thickness of the external housing of the suppressor. However, such an approach may significantly increase the weight of such suppressors and torque exerted on a weapon, thus hampering their usefulness.

Another problem with existing suppressors relates to their ability to function effectively as muzzle flash suppressors. While the distal, or exit end of a prior art silencer is typically disposed forward of the actual muzzle end of the weapon's barrel, it is nevertheless possible for the suppressor to exhibit a relatively large muzzle flash when a "first round" is fired through the device (e.g., when the suppressor has not been recently fired). "Second" and immediately subsequent rounds fired from the suppressor typically do not exhibit this relatively large muzzle flash.

Another problem with existing suppressors relates to the mechanisms used to couple them to firearms. Such mechanisms typically include an internal mounting pin disposed in the suppressor that engages in a slot at the end of an adapter, which can comprise a flash hider or muzzle brake mounted at the muzzle end of the barrel of the firearm to which the suppressor is to be removably coupled. This arrangement can be problematic for several reasons. For instance, the mounting pin is cumbersome to manufacture, is prone to breakage, and cannot be easily repaired. Further, both the pin in the suppressor and the corresponding slot in the adapter are typically positioned well within the suppressor and, therefore, are subject to a buildup of carbon, lead and copper during firing use, as described above, which can complicate disassembly and prevent proper alignment and/or seating of the adapter within the suppressor.

SUMMARY

In accordance with various embodiments provided by the present disclosure, sound suppressors and methods for making and coupling them to firearms are provided that overcome various drawbacks associated with existing devices.

In one embodiment, a firearm sound suppressor includes a housing; a baffle; and an inner sleeve adapted to be disposed within the housing and to substantially surround the baffle, the inner sleeve comprising: a sidewall adapted to slide against the housing to permit the inner sleeve with the baffle to be selectively inserted into and removed from the housing without the baffle contacting the housing, and a longitudinal split extending through the sidewall and between front and rear ends of the inner sleeve to permit the sidewall to flex to permit removal of the baffle from the inner sleeve.

In another embodiment, a method of maintaining a firearm sound suppressor includes sliding a sidewall of an inner sleeve against a housing to remove the inner sleeve from the housing while the inner sleeve substantially surrounds a baffle and without the baffle contacting the housing; exerting a force on the sidewall, wherein a longitudinal split extends through the sidewall and between front and rear ends of the inner sleeve to permit the sidewall to flex in response to the force; and removing the baffle from the inner sleeve while the sidewall flexes.

In another embodiment, a method of manufacturing a firearm sound suppressor includes providing at least one baffle; providing an inner sleeve comprising: a sidewall, and a longitudinal split extending through the sidewall and between front and rear ends of the inner sleeve to permit the sidewall to flex; exerting a force on the sidewall to cause the sidewall to flex; and inserting the baffle from the inner sleeve while the sidewall flexes.

In another embodiment, a firearm sound suppressor includes a housing comprising a front end and a rear end, wherein the rear end comprises a flange that partially encloses the rear end and defines a rear aperture; and a back end member disposed substantially within the rear end of the housing and comprising a rear surface disposed in abutment with an inner surface of the flange to prevent the back end member from passing through the rear aperture.

In another embodiment, a method of assembling a firearm sound suppressor includes inserting a back end member into a front aperture at a front end of a housing, wherein the housing comprises a flange at a rear end thereof that partially encloses the rear end and defines a rear aperture; and sliding the back end member to the rear end of the housing until the back end member is disposed substantially within the rear end of the housing and a rear surface of the back end member abuts an inner surface of the flange to prevent the back end member from passing through the rear aperture.

In another embodiment, a method of removing a firearm sound suppressor includes exerting rotational force on a housing relative to a barrel end of a firearm, wherein: the housing comprises a front end and a rear end; the rear end comprises a flange that partially encloses the rear end and defines a rear aperture; a back end member is disposed substantially within the rear end of the housing and comprising a rear surface disposed in abutment with an inner surface of the flange to prevent the back end member from passing through the rear aperture; and complementary anti-rotation features provided by the back end member and the flange engage with each other to prevent rotation of the back end member relative to the housing while the rotational force is exerted.

In another embodiment, a firearm sound suppressor includes a housing; an interior member disposed within the housing so as to define a chamber between an exterior surface of the interior member and an interior surface of the housing, the interior member comprising a lumen and a plurality of vents extending through the interior member between the lumen and the chamber, wherein the vents are adapted to pass combustion gases from the lumen to the chamber; and a blast deflector disposed between the vents and the interior surface of the housing, wherein the blast deflector is adapted to prevent the combustion gases from impinging directly on the interior surface of the housing.

In another embodiment, a method of operating a firearm sound suppressor includes receiving combustion gases at a lumen of an interior member disposed within a housing so as to define a chamber between an exterior surface of the interior member and an interior surface of the housing; passing the combustion gases from the lumen through a plurality of vents extending through the interior member between the lumen and the chamber; receiving the combustion gases from the vents at a blast deflector disposed between the vents and the interior surface of the housing; and preventing, by the blast deflector, the combustion gases passed through the vents from impinging directly on the interior surface of the housing.

In another embodiment, a method of manufacturing a firearm sound suppressor includes providing a housing; providing an interior member; attaching a blast deflector to the interior member; and positioning the interior member with the blast deflector within the housing so as to define a chamber between an exterior surface of the interior member and an interior surface of the housing, the interior member comprising a lumen and a plurality of vents extending through the interior member between the lumen and the chamber, wherein the vents are adapted to pass combustion gases from the lumen to the chamber, wherein the blast deflector is disposed between the vents and the interior surface of the housing, wherein the blast deflector is adapted to prevent the combustion gases from impinging directly on the interior surface of the housing.

In another embodiment, a firearm sound suppressor includes a housing; and an end plate disposed at a front end of the housing and comprising a bore extending therethrough, wherein the bore comprises a tapered portion that opens toward a front surface of the end plate, wherein the tapered portion has an included angle in a range of approximately 10 degrees to approximately 25 degrees, wherein the bore is adapted to pass a first round and first associated gases to reduce a size of a first muzzle flash caused by a firing of the first round by a firearm when the firearm sound suppressor is substantially at thermal equilibrium with a surrounding environment.

In another embodiment, a method of operating a firearm sound suppressor includes receiving a first round fired by a firearm when the firearm sound suppressor is substantially at thermal equilibrium with a surrounding environment; and reducing a size of a first muzzle flash associated with the first round by passing the first round and first associated gases through a bore of an end plate disposed at a front end of a housing of the firearm sound suppressor, wherein the bore extends through the end plate and comprises a tapered portion that opens toward a front surface of the end plate, wherein the tapered portion has an included angle in a range of approximately 10 degrees to approximately 25 degrees.

In another embodiment, a method of manufacturing a firearm sound suppressor includes providing a housing; providing a plurality of baffles adapted to be disposed within the housing; and creating a bore extending through an end plate adapted to be disposed at a front end of the housing, wherein the bore comprises a tapered portion that opens toward a front surface of the end plate, wherein the tapered portion has an included angle in a range of approximately 10 degrees to approximately 25 degrees, wherein the bore is adapted to pass a first round and first associated gases to reduce a size of a first muzzle flash caused by a firing of the first round by a firearm when the firearm sound suppressor is substantially at thermal equilibrium with a surrounding environment.

In another embodiment, a method of aligning a firearm sound suppressor includes inserting a front portion of a body of an adapter into a socket of the firearm sound suppressor; sliding a tab of the adapter into a slot disposed in an interior surface of the socket to rotationally align the firearm sound suppressor relative to a firearm; and contacting a plug of the adapter against the interior surface in a complimentary engagement, wherein the plug is provided by a frusto-conical external surface of a rear portion of the body, wherein the tab extends from the plug.

In another embodiment, an adapter includes a body having a front portion configured to be inserted into a socket of a firearm sound suppressor; a frusto-conical external surface substantially at a rear portion of the body and providing a plug configured to be received by a complementary interior surface of the socket; and a tab extending from the plug and adapted to be received by a slot disposed in the interior surface to rotationally align the firearm sound suppressor relative to a firearm.

In another embodiment, a firearm sound suppressor includes a housing; and a socket disposed in a rear section of the housing and configured to receive a front portion of a body of an adapter, wherein the socket comprises an interior surface configured to receive a plug in a complimentary engagement, wherein the plug is provided by a frusto-conical external surface of a rear portion of the body, wherein a slot disposed in the interior surface is adapted to receive a tab of the adapter to rotationally align the firearm sound suppressor relative to a firearm, wherein the tab extends from the plug.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
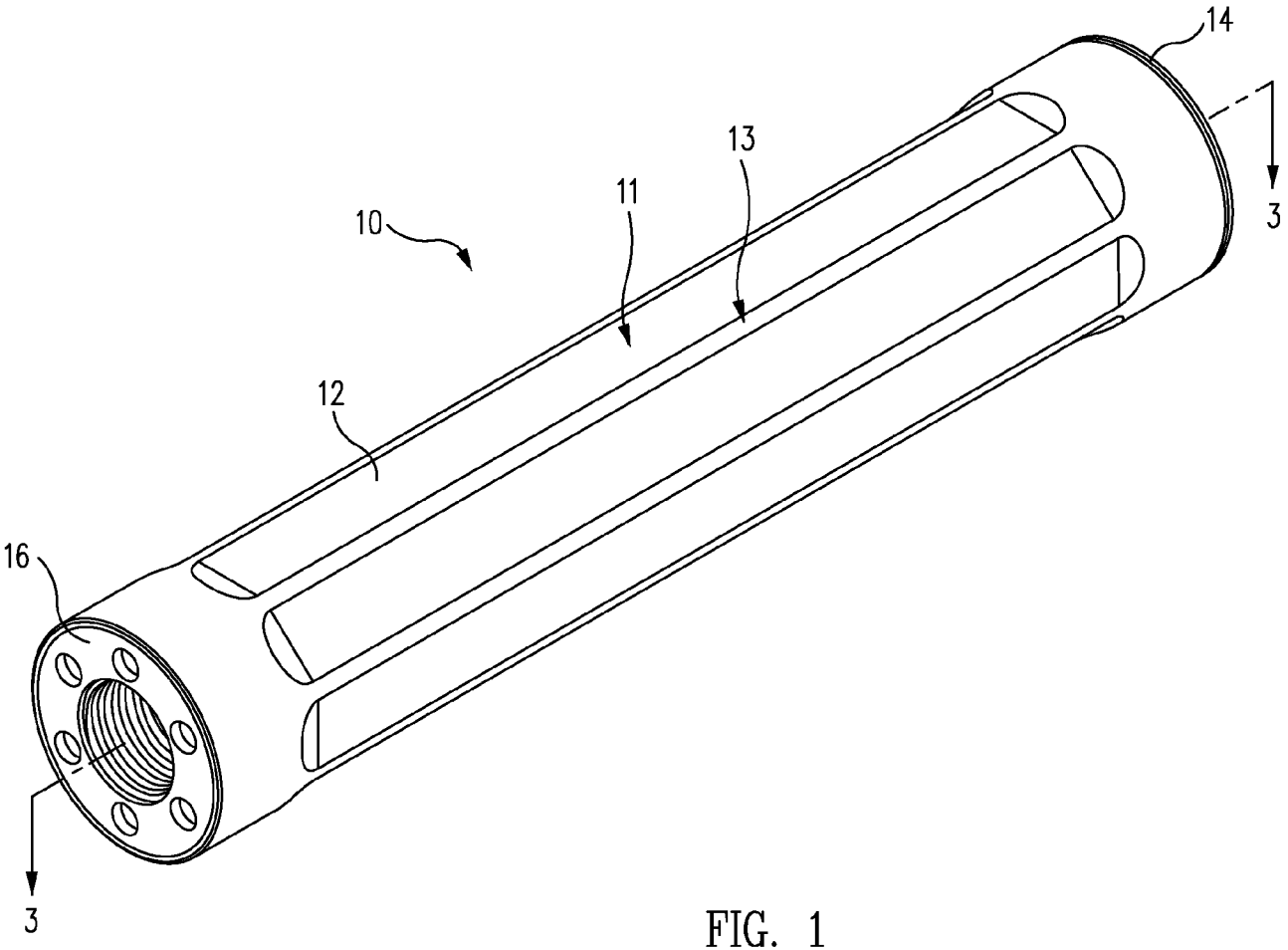
FIG. 1 is an upper, rear, right side perspective view of a firearm sound suppressor in accordance with an embodiment of the disclosure.
Figure 2:
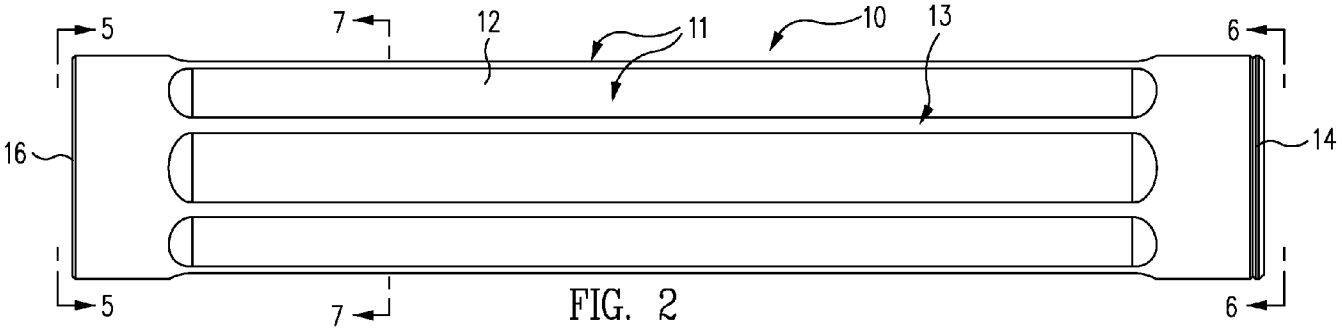
FIG. 2 is a top plan view of the suppressor of FIG. 1 in accordance with an embodiment of the disclosure.
Figure 3:
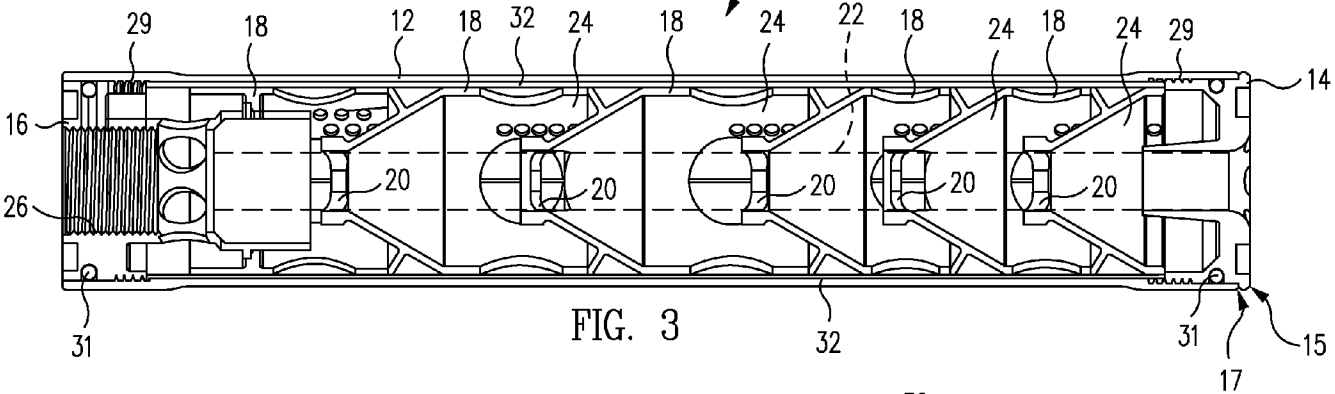
FIG. 3 is a cross-sectional view of the suppressor of FIG. 1, as seen along the lines of the section 3-3 taken therein, showing a plurality of baffles disposed coaxially therein in accordance with an embodiment of the disclosure.
Figure 4:
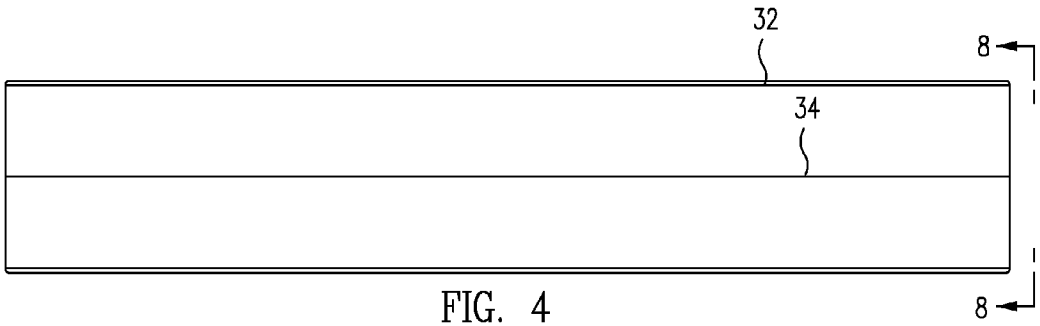
FIG. 4 is a cross-sectional view of a split inner tube of the suppressor of FIG. 1 in accordance with an embodiment of the disclosure.

A firearm sound suppressor 10 is illustrated in the perspective, top plan, and cross-sectional views of FIGS. 1-3, respectively. As shown, the suppressor 10 includes an elongated substantially tubular housing 12, front and rear end plates 14 and 16, respectively, disposed at corresponding ends of the housing 12, and baffles 18 disposed concentrically within the housing 12 and between the two end plates 14 and 16. Although housing 12 and various other housings referred to herein are illustrated as having generally cylindrical shapes, such housings may be implemented using any shape (e.g., square, rectangular, triangular, polygonal, or others) in other embodiments as may be desired for particular applications.

In the particular embodiments illustrated in FIGS. 1-3, baffles 18 each contain a central aperture 20 and are disposed coaxially within the housing 12 such that they are distributed along the long axis thereof, with their central apertures 20 collectively defining an interrupted central lumen 22 within the housing 12, through which a projectile (not illustrated) fired through the suppressor 10 travels. Adjacent ones of the baffles 18 define a series of combustion gas expansion chambers 24 therebetween.

Figure 5:
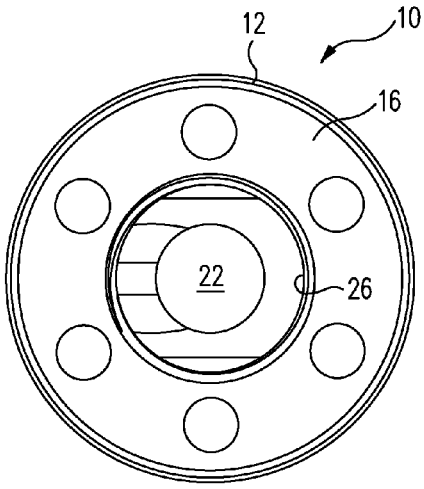
FIG. 5 is rear end elevation view of the suppressor of FIG. 1, as seen along the lines of the rear end view 5-5 taken in FIG. 2 in accordance with an embodiment of the disclosure.
Figure 6:
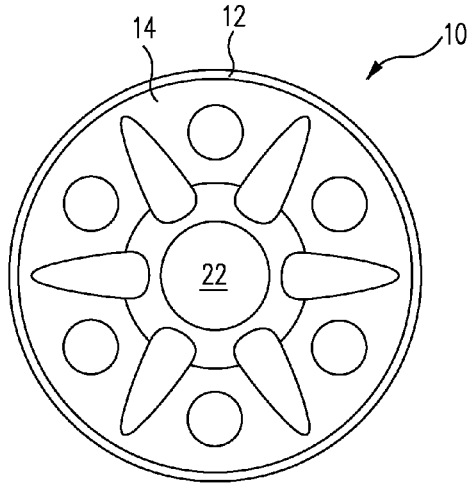
FIG. 6 is a front end elevation view of the suppressor of FIG. 1, as seen along the lines of the front end view 6-6 taken in FIG. 2 in accordance with an embodiment of the disclosure.
Figure 9:
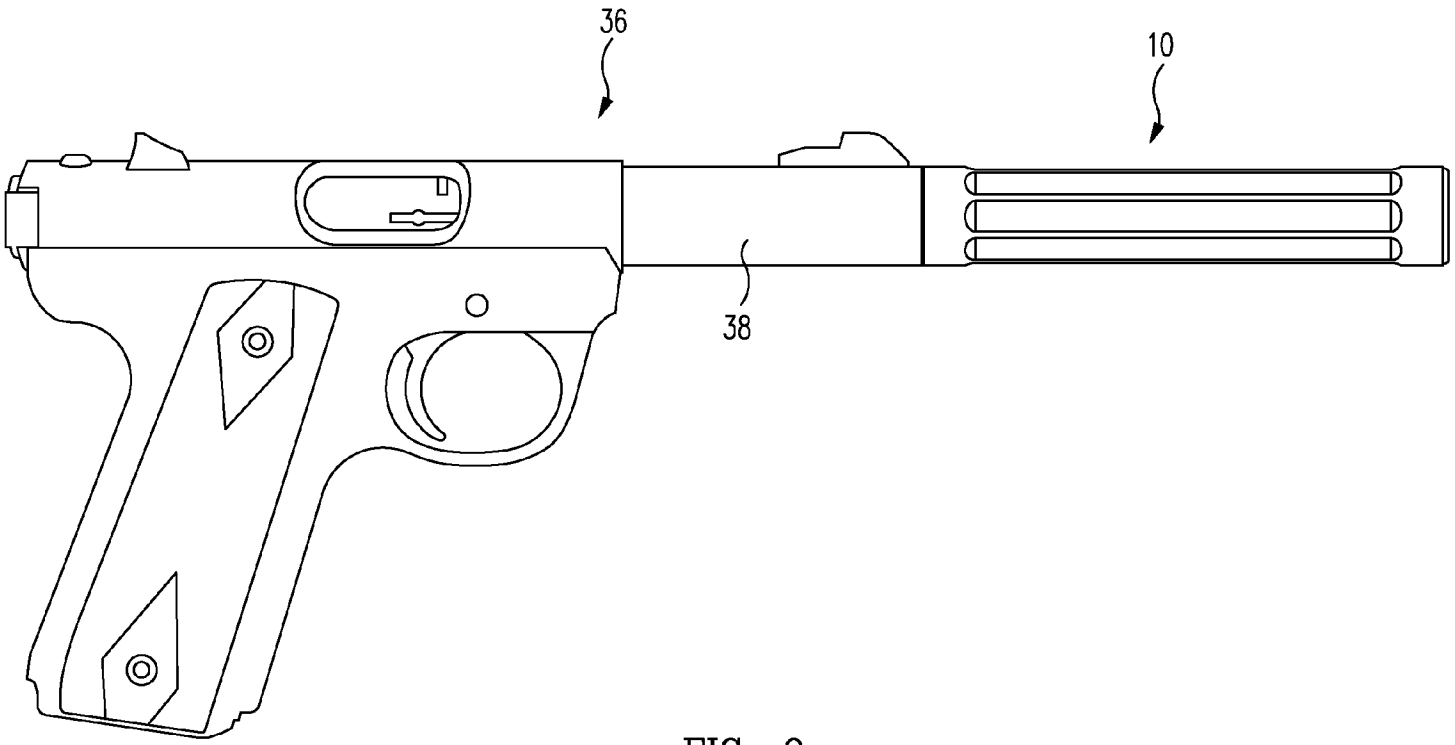
FIG. 9 is a right side elevation view of the suppressor of FIG. 1, shown coupled to the muzzle end of a barrel of a pistol in accordance with an embodiment of the disclosure.

The rear end plate 16 of the suppressor 10 can include a mechanism for removably coupling the suppressor 10 to a firearm 36, such as that illustrated in FIG. 9. As illustrated in, e.g., FIGS. 3 and 5, this coupling mechanism can include an internal thread (e.g., approximately ½ inch×28 threads per inch (TPI) in one embodiment) disposed in an aperture 26 in the rear end plate 16 that is adapted to engage a complementary external thread disposed on a muzzle end of the barrel 38 of the firearm 36. However, as discussed below in connection with other suppressor embodiments, it should be understood that these or other mechanisms can be used to couple the suppressor 10 to the firearm 36 or other types of firearms as may be desired.

As illustrated in FIG. 3, the front and rear end plates 14 and 16 can be coupled to corresponding ends of the housing 12 by external threads 28 and 29, respectively. In this regard, threads 28 and 29 may be disposed on plates 14 and 16 and adapted to engage with complementary internal threads disposed in corresponding ends of the housing 12, so that the end plates 12 and 14 can be screwed into or out of the ends of the housing 12 for assembly and disassembly. As further illustrated in FIG. 3, the front end plate 14 may include a lip 15 configured to abut a front surface 17 of the housing 12 when the front end plate 14 is fully screwed into the housing 12. Additionally, O-rings 30 and 31 can be disposed in corresponding circumferential grooves between an outer circumfery of the end plates 14 and 16, respectively, and an inner circumfery of the housing 12 to seal the ends of the suppressor 10 and/or to provide insulation from vibration. Other end plate sealing and coupling mechanisms can be used, such as flat gaskets and/or complementary lugs and channels respectively disposed on various mating parts.

As may be seen in FIG. 3, the baffles 18 are typically arranged in a longitudinal "stack," which can comprise a plurality of individual baffles separated by spacers, individual baffles with integral spacers, or a stack of baffles that are formed integrally with each other during their manufacturing process. For example, in some embodiments, baffles may be used such as those described in U.S. patent application Ser.

No. 12/972,409 filed Dec. 17, 2010 which is incorporated herein by reference in its entirety.

As previously discussed, in known suppressor designs where gas expansion chambers communicate directly with interior wall surfaces of suppressor housings, particulate contaminates contained in the combustion gases confined in the device will condense out and be deposited over the entire interior surfaces of such suppressors. Such deposits are typically hard and adhesive in nature, making it difficult or impossible to disassemble such suppressors for cleaning without damaging its constituent parts.

However, such problems are readily overcome in the suppressor 10 of FIGS. 1-9 by the provision of an inner tube 32 (e.g., also referred to as an inner sleeve or a baffle sleeve) made of a resilient material, such as aluminum, steel, a polymer, and/or other material, and having a sidewall and front and rear ends generally conterminous with corresponding ends of the housing 12. Although inner tube 32 is illustrated as having a generally cylindrical shape, it may be implemented as an inner sleeve or baffle sleeve using any shape (e.g., square, rectangular, triangular, polygonal, or others) in other embodiments as may be desired for particular applications.

Figure 7:
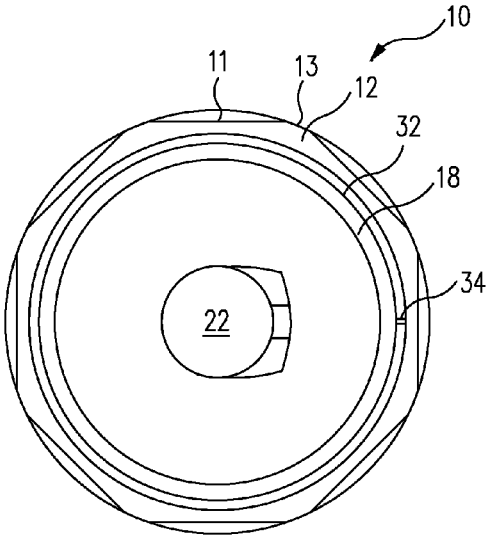
FIG. 7 is a cross-sectional view through the suppressor of FIG. 1, as seen along the lines of the section 7-7 taken in FIG. 2 in accordance with an embodiment of the disclosure.
Figure 8:
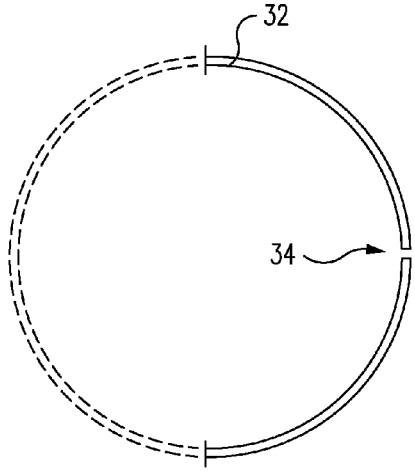
FIG. 8 is a front end sectional view of the split inner tube of FIG. 4, as seen along the lines of the front end view 8-8 taken therein in accordance with an embodiment of the disclosure.

As illustrated in, e.g., FIGS. 3 and 7, the inner tube 32 is disposed concentrically within the housing 12 and around the baffles 18 to act a barrier against the impingement of contaminants on the interior surface of the housing 12. As illustrated in, e.g., FIGS. 4 and 8, the inner tube 32 has a single longitudinal slot or split 34 extending through the sidewall of the tube and between the front and rear ends thereof so as to enable the sidewall of the tube 32 to flex in a generally radial direction in response to substantially radial force, and thereby permit the suppressor to be easily disassembled for cleaning.

For example, in one possible scenario, a heavily used suppressor 10 can be cleaned in the following manner. The front and rear end plates 14 and 16 are first removed from the corresponding ends of the housing 12, e.g., by unscrewing them therefrom. The inner tube 32 and the stack of baffles 18 can then be easily slid from within the housing 12 (e.g., selectively inserted into and removed from the housing 12 in a slidable fashion), since the inner tube 32 has prevented adhesive combustion deposits from forming between baffles 18 and the inner surface of the housing 12. In this regard, a substantially uncontaminated (e.g., clean) outer surface of inner tube 32 contacts a substantially uncontaminated (e.g., clean) inner surface of housing 12, thus permitting the inner tube 32 to be easily slid out of the housing 12 while the stack of baffles 18 remains contained in the inner tube 32. The stack of baffles 18 can then be removed from within the inner tube 32, and various surfaces of the tubular housing 12, the front and rear end plates 14 and 16, the baffles 18, and the inner tube 32 can then be easily cleaned of any combustion residue with a suitable gun solvent or other appropriate manner.

In circumstances where the inner surface of the inner tube 32 and outer surfaces of the baffles 18 are firmly adhered to each other by the combustion residue so as to form an integral assembly, the entire assembly can be slid out of the tubular housing 12 in a longitudinal direction, and the baffles 18 can then be easily removed from within the inner tube 32 by gently expanding the side wall of the inner tube 32 in the radial direction so as to break any adhesion between the inner tube 32 and the baffles 18 caused by any combustion residue therebetween and permit removal of the baffles 18 and cleaning of the baffles 18 and the inner tube 32. Such expansion may be facilitated, for example, by providing the longitudinal slot 34 in the inner tube. In certain embodiments, the inner tube 32 may be constructed of a substantially flexible material (e.g., aluminum, flexible steel, or other materials) to permit expansion of the side wall of the inner tube in response to radial pressure exerted by a user. As those of skill in the art will appreciate, the various components of the suppressor 10 can be fabricated using a variety of methods and from a variety of materials, including heat treatable alloys of aluminum (e.g., anodized aluminum in one embodiment), steel (e.g., stainless steel in one embodiment), and/or titanium.

As illustrated in FIGS. 1 and 2, the housing 12 can be provided with substantially planar surfaces 11 disposed longitudinally along the housing 12. In this regard, the suppressor 10 is illustrated as having eight planar surfaces 11 substantially uniformly distributed around the outer surface of the housing 12 to provide an outer profile that is substantially octagonal in shape. Other numbers of planar surfaces 11 may be provided in other embodiments to provide any other desired outer profile (e.g., hexagonal, polygonal, or other profiles).

In various embodiments, the planar surfaces 11 may be implemented to save weight. In this regard, in one embodiment, the suppressor 10 may exhibit a weight of approximately 2.6 ounces, a length of approximately 5.4 inches, and a diameter of approximately 1.0 inch. As shown in FIGS. 2 and 7, the planar surfaces 11 may be recessed such that the external portion of the housing 12 along the planar surfaces 11 exhibits a smaller external diameter than end plates 14 and 16. The structural integrity of the housing 12 may be reinforced by unrecessed thicker portions 13 of the housing 12 located between adjacent planar surfaces 11. In this regard, opposite unrecessed thicker portions 13 may collectively exhibit an external diameter substantially equal to that of the ends of the housing 12. The structural integrity of the housing may also be reinforced by the thick walls of end plates 14 and 16 (shown in FIG. 3).

FIG. 9 illustrates the suppressor 10 coupled to the muzzle end of the barrel 38 of a firearm 36, e.g., a .22 caliber semiautomatic pistol. In several embodiments, suppressor 10 may be used with various types of weapons such as, for example, fully automatic rimfire weapons, .22 caliber pistols (e.g., Walther P22, Ruger 22/45, or others), rifles, or other types where appropriate. In several embodiments, suppressor 10 may be used with various types of ammunition such as, for example, 0.22 Long Rifle (LR), 0.22 Magnum (Mag), 0.17 Homady Magnum Rimfire (HMR), or other types where appropriate. However, it should be understood that the suppressor 10 can also be used with firearms of different calibers and of different types, such as semiautomatic or fully automatic machine pistols or rifles.

As discussed, in certain suppressor implementations where front and rear end caps are threadably secured to a housing, the rear end cap may be susceptible to becoming unscrewed from the housing during removal of such suppressors from an adapter or firearm. Another embodiment of a sound suppressor 50 in accordance with the present disclosure is illustrated in FIGS. 10A-J that overcomes such problems. It will be appreciated that the suppressor 50 includes various features previously described with regard to the suppressor 10. However, the suppressor 50 provides a different housing 52, a different front end plate 54, and a back end member 62.

The housing 52 includes an open front end defining an aperture 56 and a partially closed rear end implemented with a flange 58 that partially encloses the rear end and defines an aperture 60. The back end member 62 is disposed substantially concentrically within the housing 52, at the rear thereof. The back end member 62 has a rear surface 64 that, when the suppressor 50 is assembled, is disposed in abutment with an inside surface 66 of the flange 58 of the housing 52 to prevent the back end member 62 from passing through the aperture 60. In one embodiment, the rear surface 64 and the inside surface 66 may both be substantially flat surfaces, such that the rear surface 64 provides a plate adapted to contact the flange 58. The back end member 62 also includes an internally threaded bore 26 extending through it, the bore 26 being disposed in coaxial alignment with the aperture 60 when the suppressor 50 is assembled.

The back end member 62, the front end plate 54, or both may include a circumferential groove 78 for an O-ring to effect a circumferential seal at a corresponding end of the housing 52 and/or to provide insulation from vibration, in a manner similar to that described with regard to the suppressor 10.

The front end plate 54 inserts into the front end aperture 56. The front end plate 54 has a bore 68 extending therethrough that is disposed in coaxial alignment with the bore 26 of the back end member 62. The front end plate 54 also includes an external thread 29 disposed on a circumfery thereof. The thread 29 is configured to engage in a complementary internal circumferential thread 70 disposed in an interior surface of the front end of the housing 52.

The bore 26 of the back end member 62 has an internal circumferential thread disposed in an interior surface thereof that is configured to engage a complementary external circumferential thread disposed on a circumfery of an adapter or a muzzle end portion of a barrel of an associated firearm in a similar manner as discussed with regard to the suppressor 10.

In order to prevent the back end member 62 from rotating relative to the housing 52 during removal of the suppressor 50 from the muzzle of an associated firearm, the suppressor 50 is provided with complementary anti-rotation features provided by the flange 58 and the back end member 62 that are operable, when engaged with each other, to prevent the back end member 62 from rotating about a long axis of, and relative to, the housing 52.

In one embodiment, the anti-rotation features include a rearwardly protruding boss 72 disposed on the rear surface 64 of the back end member 62 that is configured to engage the aperture 60 defined by the flange 58 at the rear end of the housing 52 in a complementary, axial slide-in engagement.

In one embodiment, the anti-rotation features may include one or more substantially radial protrusions 74 provided by the boss 72 and at least one corresponding complementary substantially radial slot 76 disposed in a circumfery of the aperture 60 defined by the flange 58. In this embodiment, the radial protrusions 74 and the corresponding complementary radial slots 76 are disposed in substantial rotational symmetry about the long axis of the housing 52 in a star-like pattern, thereby enabling the boss 72 of the back end member 62 to be axially inserted into the aperture 60 at the rear end of the housing 52 in a plurality of angular orientations relative thereto.

When a user or machine exerts rotational force on the housing 52 or other portions of the suppressor 50 relative to a barrel end of a firearm to unscrew the suppressor 50 from the firearm, the radial protrusions 74 are respectively engaged in corresponding ones of the slots 76 and thereby prevent the back end member 62 from rotating relative to the housing 52. Thus, the suppressor 50 can be detached completely from the associated firearm, e.g., for disassembly and cleaning, without the back end member 62 separating from the suppressor 50 or remaining attached to the associated firearm.

In one embodiment, the suppressor 50 may be assembled in the following manner, and may be disassembled in a reverse manner. The back end member 62 is inserted through the front aperture 56 and slid toward the flange 58 such that the rear surface 64 of the back end member 62 is disposed in abutment with the inner surface 66 of the flange 58 and the anti-rotation features 72 and 74 of the back end member 62 are respectively disposed in engagement with the anti-rotation features 60 and 76 of the flange 58. The baffles 18 are disposed substantially concentrically within the inner tube 32, and the sidewall of the inner tube 32 is compressed around the baffles 18 in a radial direction so as to form an integral assembly therewith. The integral assembly is then slid into the housing 52 in a longitudinal direction and into contact with the back end member 62. In another embodiment, the back end member 62 and the integral assembly may be slid together in the housing 52 (e.g., the back end member 62 may contact or engage with the integral assembly before being inserted into the housing 52). The front end plate 54 is then inserted into the front end aperture 56 such that the back end member 62 and the integral assembly of the inner tube 32 and baffles 18 are pressed between the front end plate 54 and the rear end of the housing 52.

The front end plate 54 may be screwed into the housing 52 through the engagement of threads 29 and 70. Advantageously, because the engagement of the back end member 62 and the flange 58 causes the back end member 62 to be rigidly fixed with respect to the housing 12, the front end plate 54 may be used as a single mechanism to tighten the entire suppressor 50 together. In this regard, as front end plate 54 is screwed into the housing 52, the flange 58, the back end member 62, the baffles 18, the inner tube 32, and the front end plate 54 may all be tightened together.

A front surface 80 of the front end plate 54 can be provided with one or more indentations 82 configured to engage with an appropriate tool that may be used to screw the front end plate 54 into or out of the housing 52.

Figure 10A:
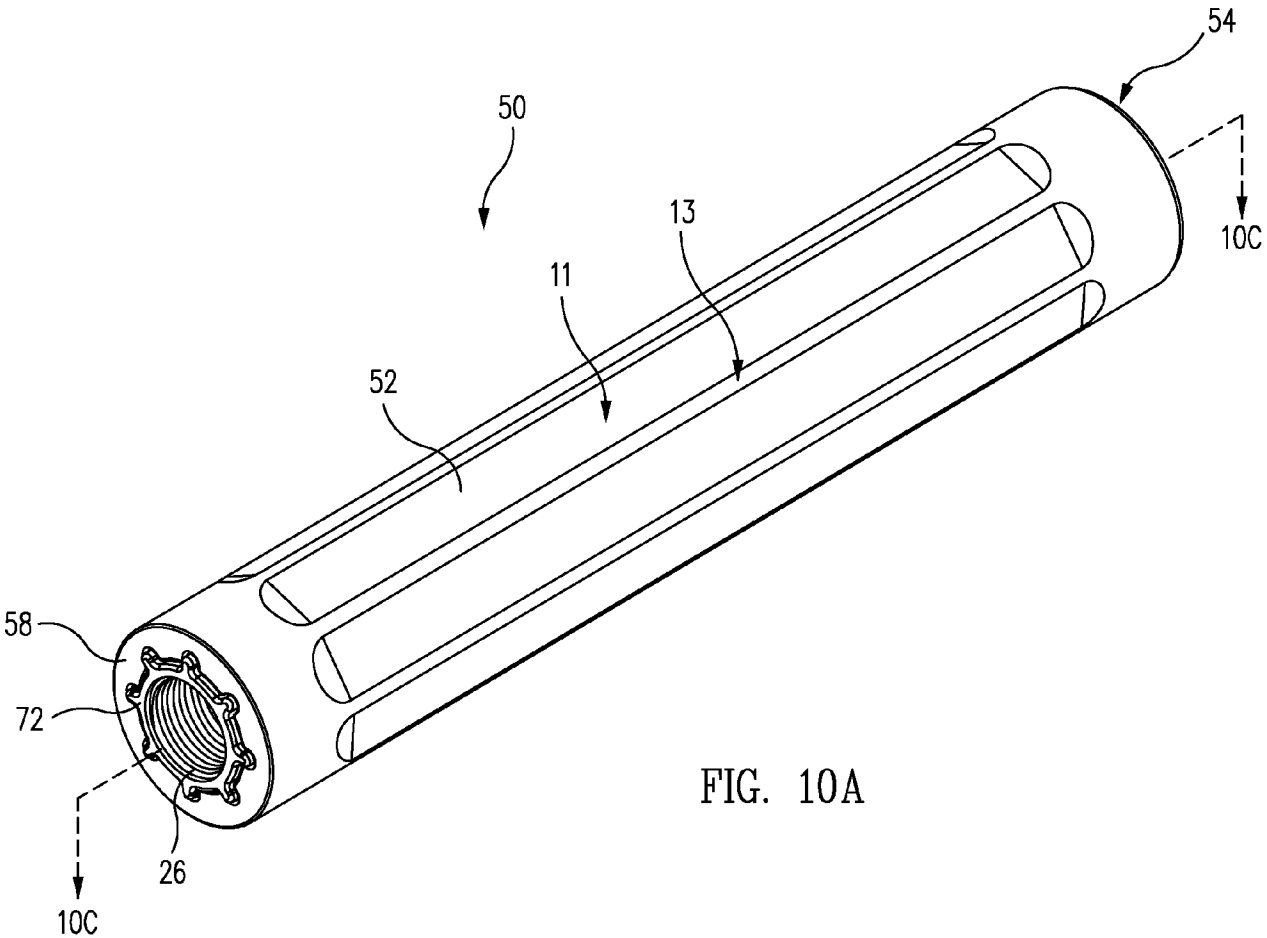
FIG. 10A is an upper, rear, right side perspective view of another firearm sound suppressor in accordance with an embodiment of the disclosure.
Figure 10B:
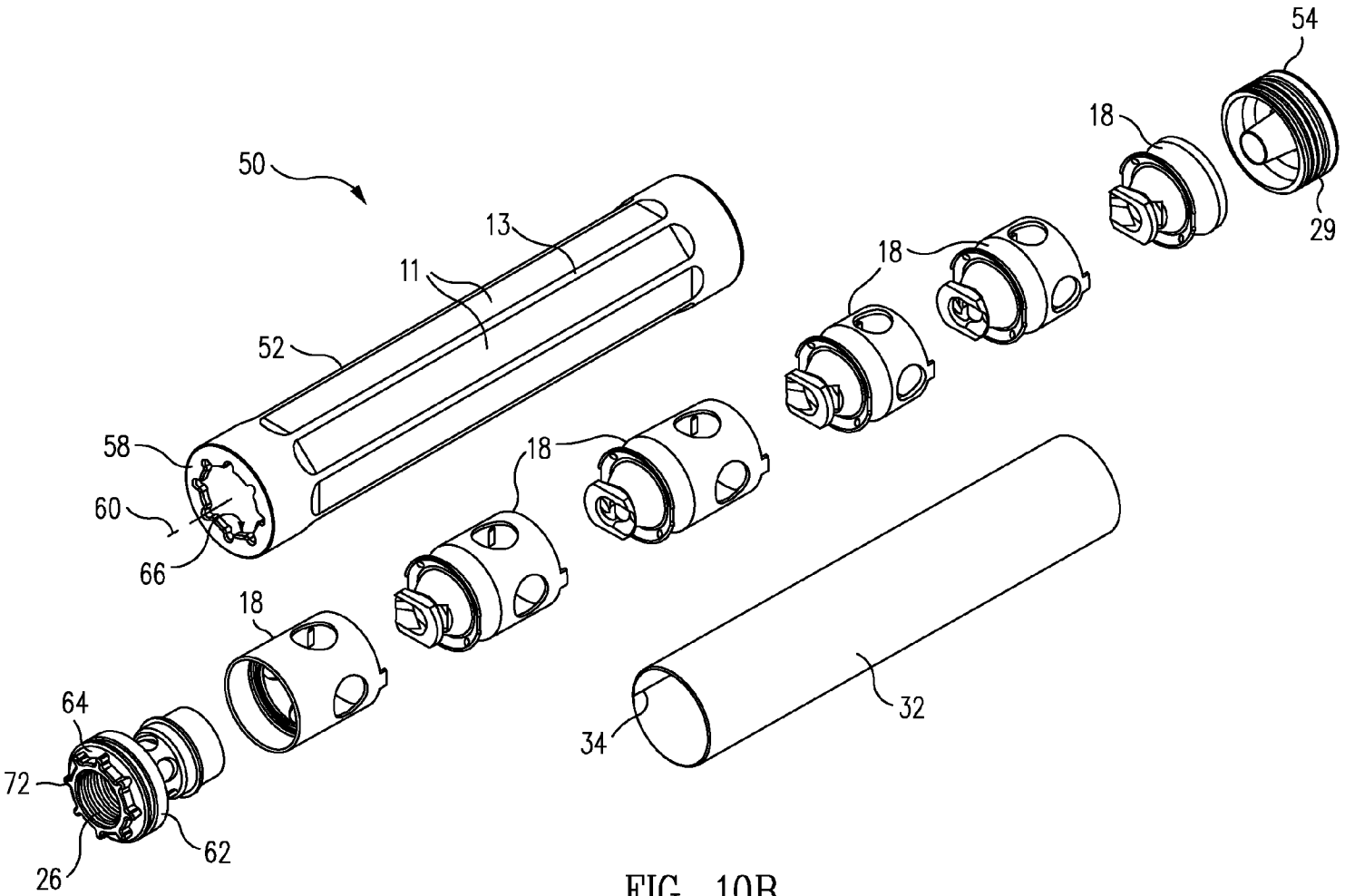
FIG. 10B is an exploded perspective view of the suppressor of FIG. 10A in accordance with an embodiment of the disclosure.
Figure 10C:
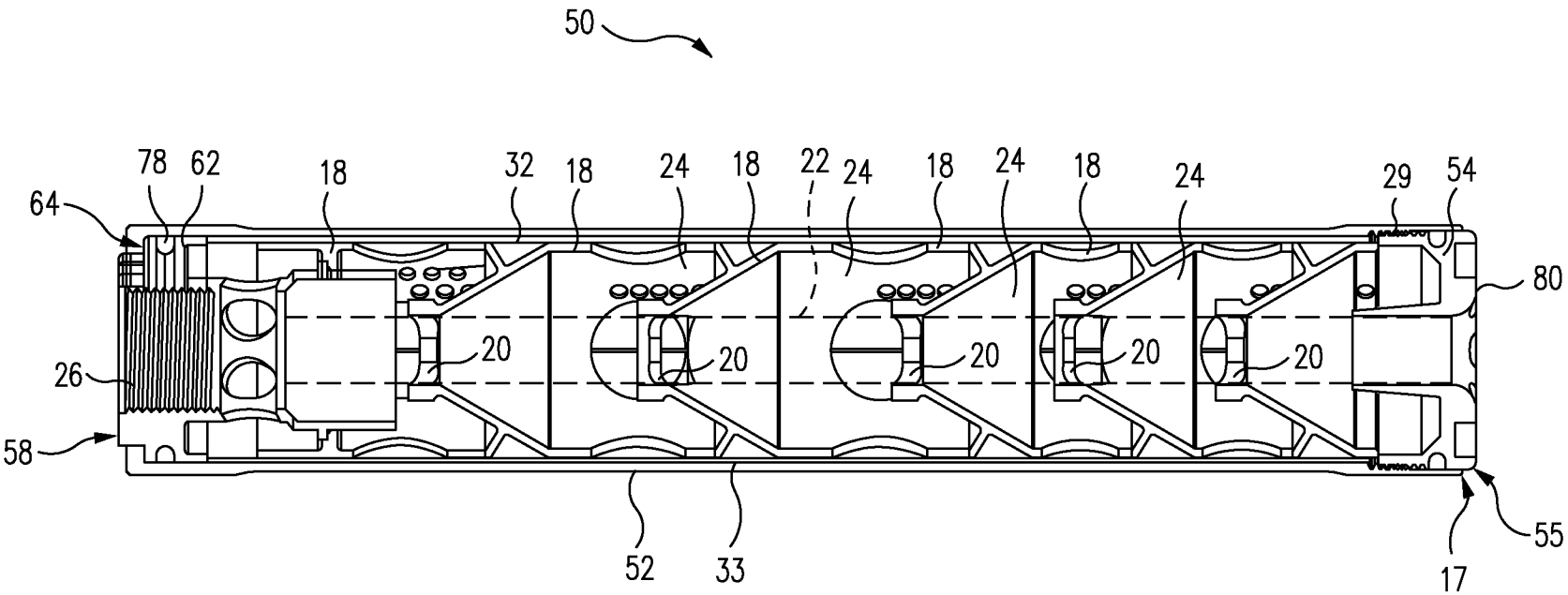
FIG. 10C is a cross-sectional view of the suppressor of FIG. 10A, as seen along the lines of the section 10C-10C taken therein, showing a plurality of baffles disposed coaxially therein in accordance with an embodiment of the disclosure.
Figure 10D:
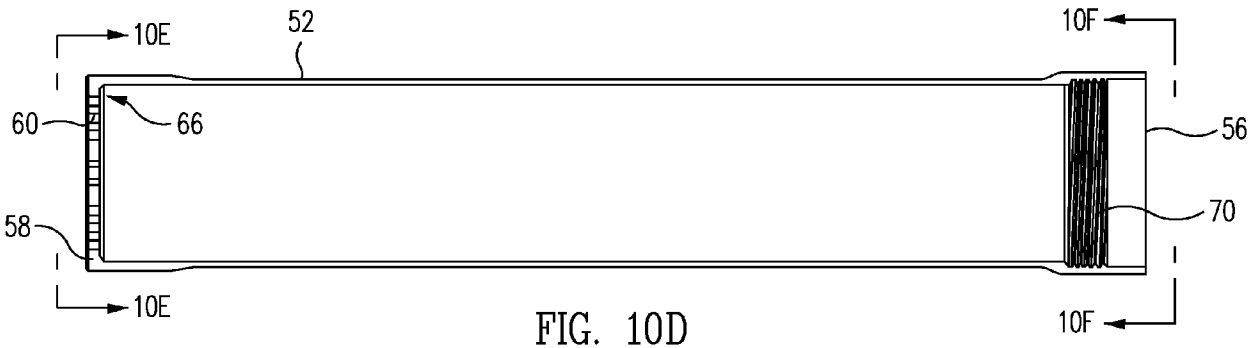
FIG. 10D is a cross-sectional view of the housing of the suppressor of FIG. 10A, as seen along the lines of the section 10C-10C taken therein, in accordance with an embodiment of the disclosure.
Figure 10F:
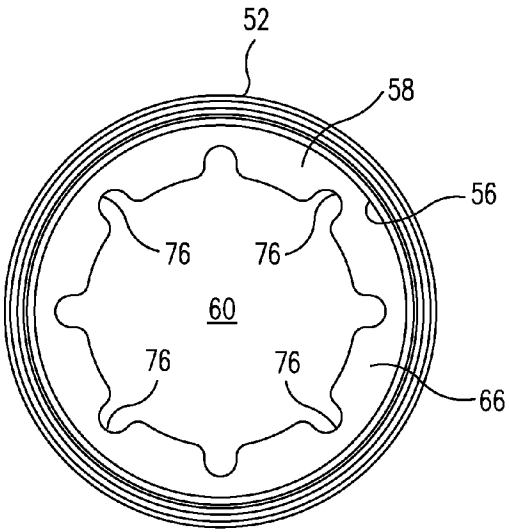
FIG. 10F is an elevation view of a front end of the housing of FIG. 10D, as seen along the lines of the front end view 10E-10E taken therein in accordance with an embodiment of the disclosure.
Figure 10E:
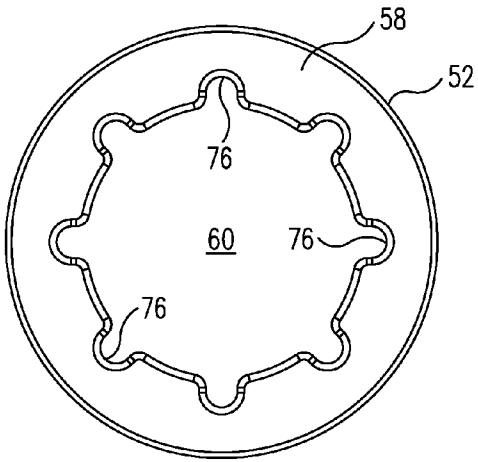
FIG. 10E is an elevation view of a rear end of the housing of FIG. 10D, as seen along the lines of the rear end view 10E-10E taken therein in accordance with an embodiment of the disclosure.
Figure 10G:
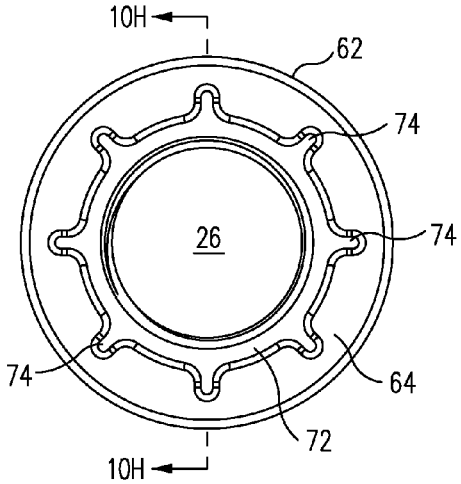
FIG. 10G is a rear elevation view of a back end member of the suppressor of FIG. 10A in accordance with an embodiment of the disclosure.
Figure 10H:
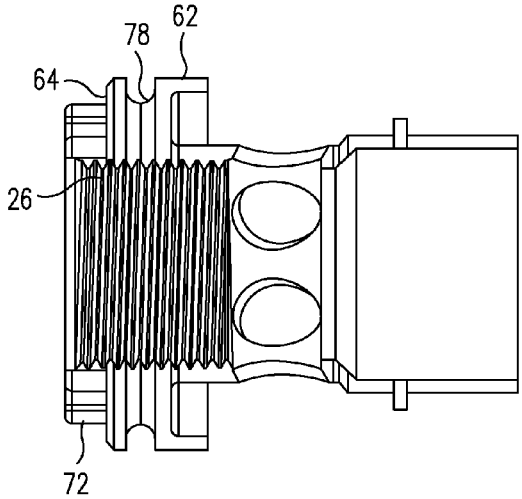
FIG. 10H is a cross-sectional view of the back end member of FIG. 10G, as seen along the lines of the section 10H-10H taken therein in accordance with an embodiment of the disclosure.
Figure 10I:
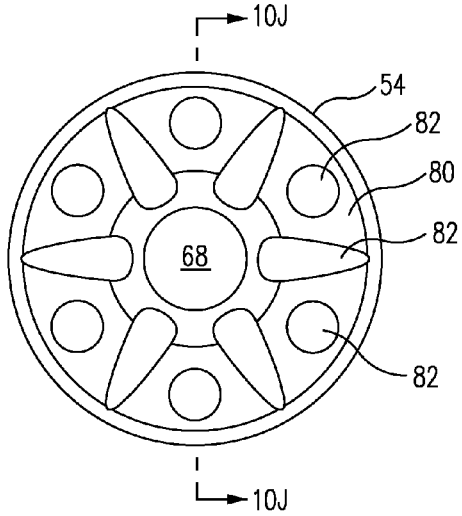
FIG. 10I is a front elevation view of a front end plate of the suppressor of FIG. 10A in accordance with an embodiment of the disclosure.
Figure 10J:
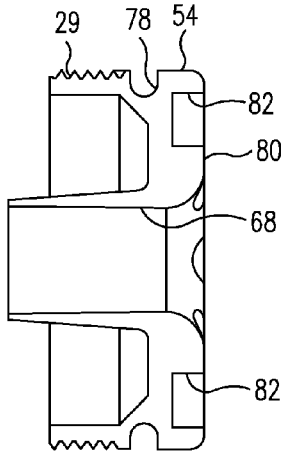
FIG. 10J is a cross-sectional view of the front end plate of FIG. 10I, as seen along the lines of the section 10J-10J taken therein in accordance with an embodiment of the disclosure.

As shown in FIG. 10C, the front end plate 54 may include a substantially rounded surface 55 (e.g., in contrast to the lip 15 shown in FIG. 3 for the suppressor 10). As a result, the front surface 80 of the front end plate 54 may be recessed within the housing 52 if desired. For example, because the front end plate 54 may be used as a single mechanism to tighten the entire suppressor 50 together, it may be desired in certain embodiments to screw the front end plate 54 well into the housing 52 until the front surface 80 is recessed within the housing 52 and behind the front surface 17 of the housing 52 to provide appropriate tension against the other components to hold suppressor 50 together tightly. In another embodiment, a substantially flat surface (e.g., substantially parallel to the length of the housing 52) may be used in the same manner in place of the substantially rounded surface 55.

Figure 11A:
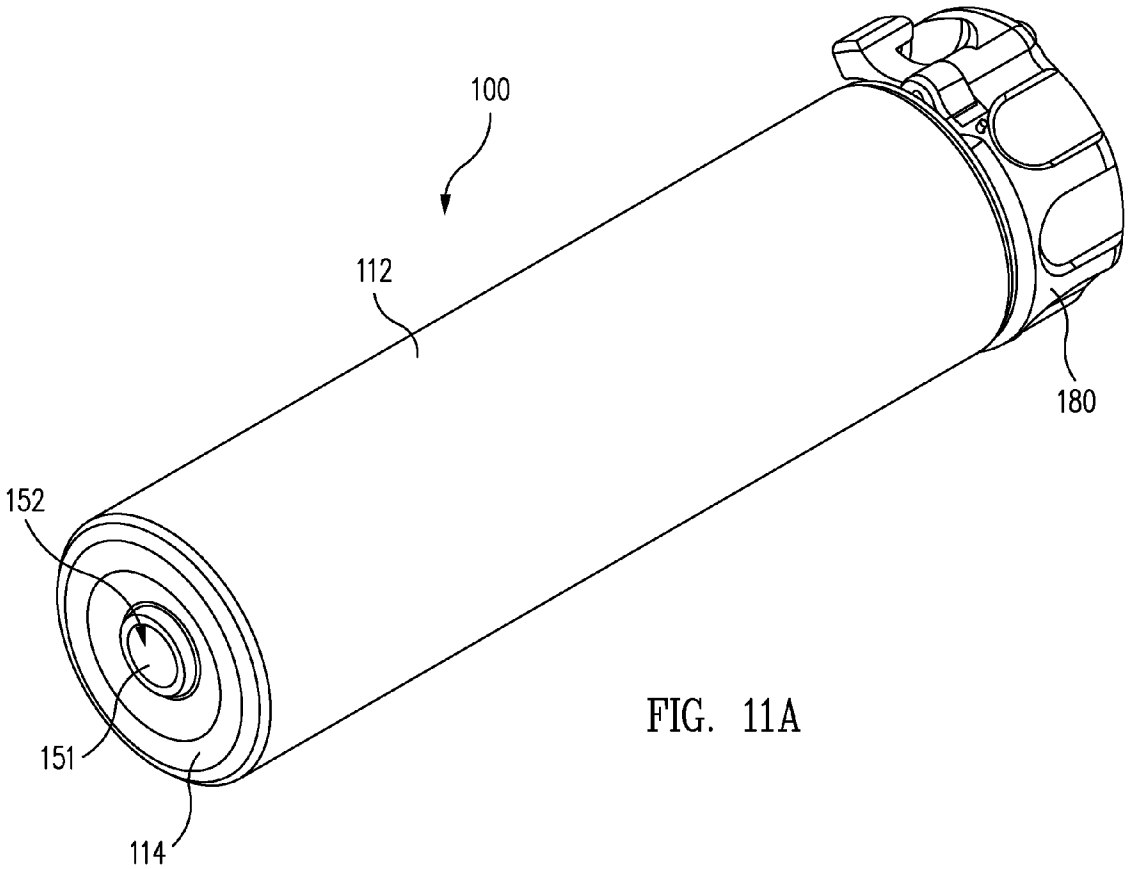
FIG. 11A is an upper, front, left side perspective view of a further firearm sound suppressor in accordance with an embodiment of the disclosure.
Figure 11B:
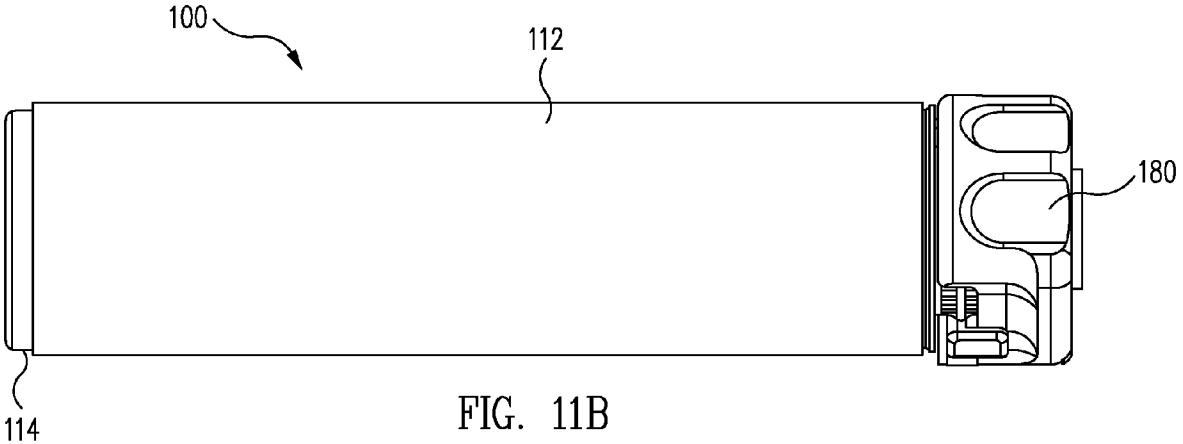
FIG. 11B is a left side elevation view of the suppressor of FIG. 11A in accordance with an embodiment of the disclosure.
Figure 12:
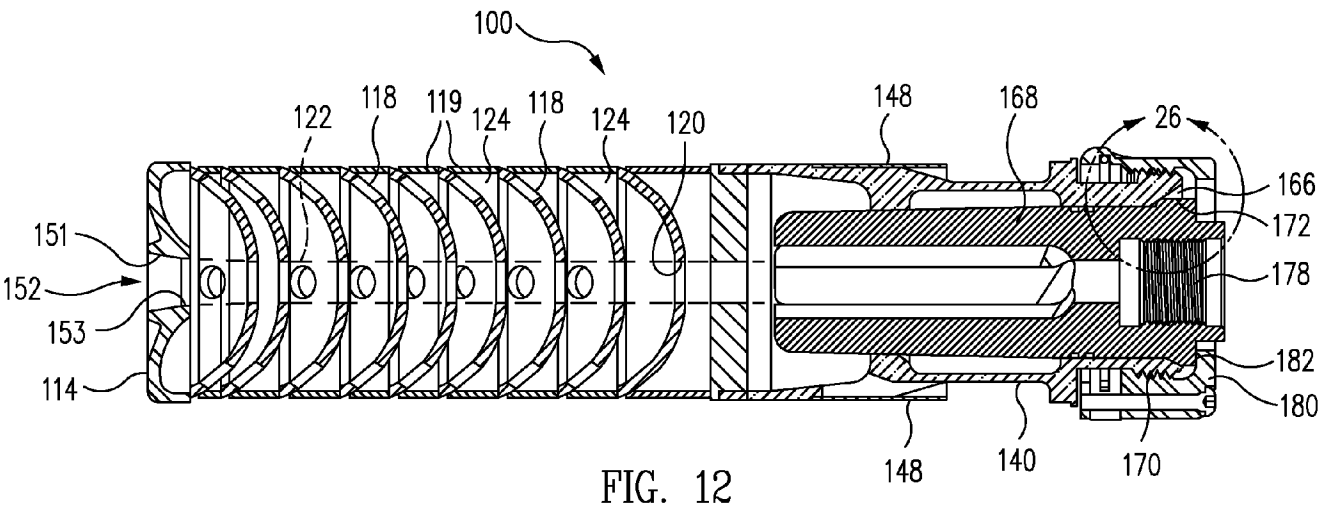
FIG. 12 is a left side cross-sectional view of the suppressor of FIG. 11A, as seen along the lines of the section 12-12 taken in FIG. 15, with the housing omitted and showing an adapter for mounting the suppressor to a firearm in accordance with an embodiment of the disclosure.

A further firearm sound suppressor 100, is illustrated in the perspective, left side elevation, and top plan views of FIGS. 11A-12, respectively. As shown, the suppressor 100 includes an elongated tubular housing 112, a front end plate 114, and a "stack" or plurality of baffles 118, each containing a central aperture 120, separated by spacers 119, disposed coaxially within a front section of the tubular housing 112, and distributed along a longitudinal axis thereof such that the central apertures 120 of the baffles 118 collectively define an interrupted central lumen 122 within the suppressor 100 and adjacent ones of the baffles 118 define gas expansion chambers 124 therebetween.

Unlike suppressor 10 discussed above, in lieu of a back end plate, the suppressor 100 includes a back end member 140 disposed in a rear section of the suppressor 100 and concentrically within the housing 112 so as to define a concentric blast suppression chamber 142 between an exterior surface of the back end member 140 and an interior surface of the tubular housing 112. In one embodiment, back end member 140 may be implemented as a tubular female mounting adapter configured to receive an adapter 168 (e.g., a flash hider 168) to attach the suppressor 100 to a firearm 160 (shown in FIG. 31) in a male-female engagement. In other embodiments, back end member 140 may receive other types of adapters such as muzzle brakes, other flash hiders, or other appropriate structures.

Figure 13:
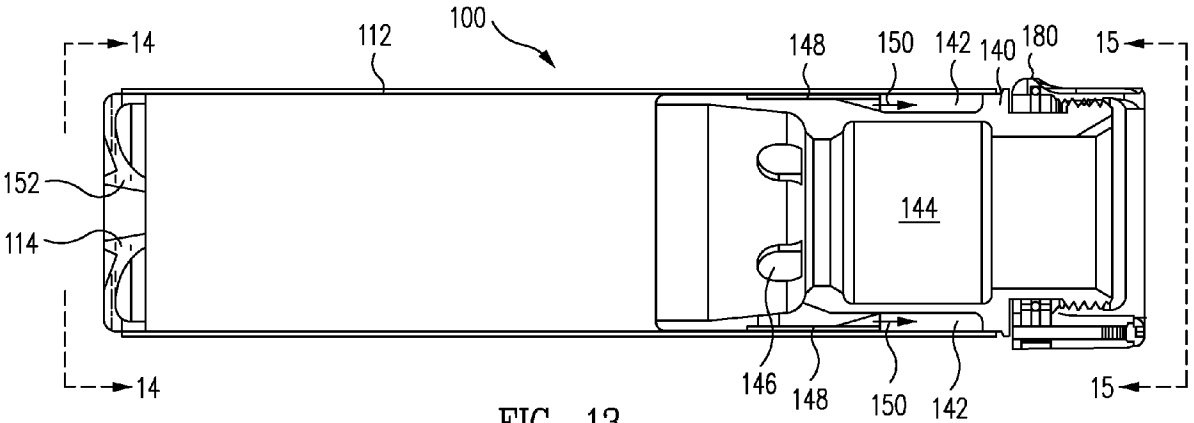
FIG. 13 is a left side cross-sectional view of the suppressor of FIG. 11A similar to FIG. 12, with the baffles and the adapter omitted and showing the housing in accordance with an embodiment of the disclosure.
Figure 15:
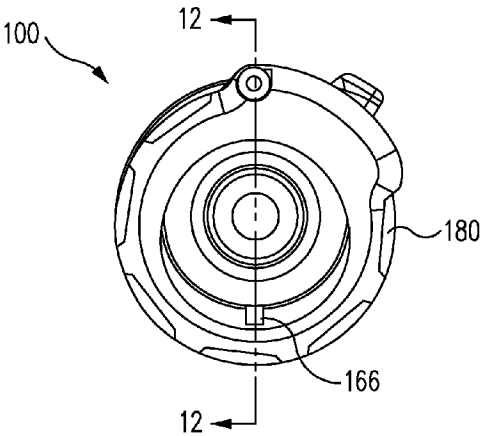
FIG. 15 is a rear end elevation view of the suppressor of FIG. 11A, as seen along the lines of the rear end view 15-15 taken in FIG. 13 in accordance with an embodiment of the disclosure.
Figure 14:
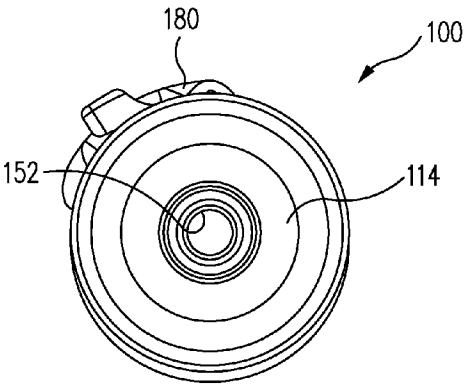
FIG. 14 is a front end elevation view of the suppressor of FIG. 11A, as seen along the lines of the front end view 14-14 taken in FIG. 13 in accordance with an embodiment of the disclosure.
Figure 16:
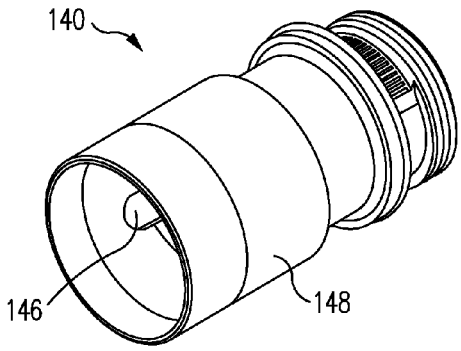
FIG. 16 is a front, left side perspective view of the back end member of the suppressor of FIG. 13 in accordance with an embodiment of the disclosure.
Figure 17:
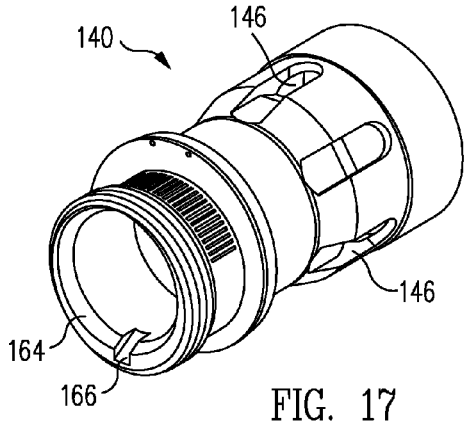
FIG. 17 is a rear, right side perspective view of the back end member of the suppressor of FIG. 13 in accordance with an embodiment of the disclosure.
Figure 18:
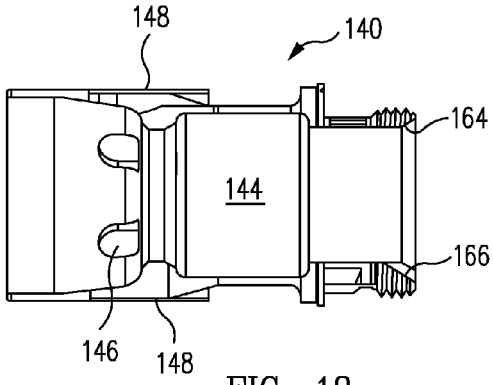
FIG. 18 is an enlarged portion of the cross-sectional view of the back end member of the suppressor of FIG. 13 in accordance with an embodiment of the disclosure.

FIG. 13 is a cross-sectional view of the suppressor 100 similar to that of FIG. 12, but with the baffles 118 and the adapter 168 omitted and showing the housing 112. The back end member 140 includes a central lumen 144 (see FIGS. 13, 18 and 20-21) disposed in coaxial alignment with the central lumen 122 of the suppressor 100 and a plurality of vents 146 (e.g., radial passages) that extend through the back end member 140 between the lumen 144 and the blast suppression chamber 142 (see FIG. 13).

Thus, it will be appreciated that the suppressor 100 may be implemented as a "two-stage" type of sound suppressor as discussed above, in which a portion of the propellant gases entering the central lumen 144 are partially diverted through the vents 146 disposed in the back end member 140 to the un-baffled, radially exterior blast suppressor chamber 142 located in the back section of the suppressor 100, before being introduced into the series of baffled expansion chambers 124 in the front section of the suppressor 100.

As discussed, in known two-stage suppressor designs, the "first stage," or blast suppressor back sections of the devices typically experience substantially greater radial pressures and temperatures than the baffled front compartments of the devices during the firing of a single round through the device which can cause premature failure, especially with sustained, full automatic weapons fire.

The suppressor 100 avoids such problems by the provision of a blast deflector 148 that is disposed substantially concentrically about the back end member 140 at the location of the vents 146. The blast deflector is effective to prevent hot gases (e.g., combustion gases) from impinging directly on the interior surface of the housing 112. Instead, the hot gases flowing from the central lumen 144 through the vents 146 impinge on the blast deflector 148 and are deflected rearwardly into the blast suppression chamber 142, as indicated by the arrows 150 in FIG. 13.

By positioning the blast deflector 148 over the vents 146, a possible point of failure in the suppressor 100 may be reduced or eliminated. Moreover, by positioning the blast deflector 148 substantially at the rear of the suppressor 100 (e.g., proximate to the back end member 140), the housing 112 can be protected from the hottest gases that are closest to the muzzle of an associated firearm (e.g., before the gases experience further cooling as they travel further down the length of the suppressor 100). In addition, the use of the blast deflector 148 provides advantageous weight savings over other protection systems. For example, because the blast deflector 148 is relatively small in comparison with the size of the housing 112, the blast deflector 148 may provide substantial weight savings over other possible protection techniques that might require increasing the overall thickness of the entire housing 112 as discussed.

Figure 19:
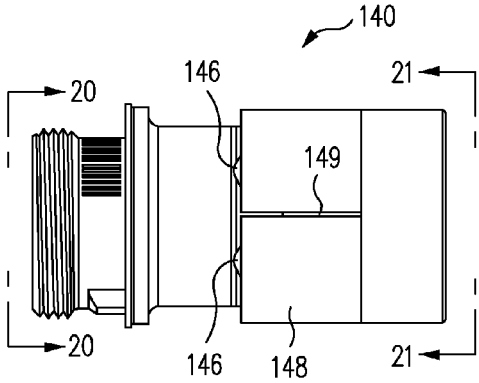
FIG. 19 is a right side elevation view of the back end member of the suppressor of FIG. 13, showing a hollow cylindrical blast shield mounted concentrically thereabout in accordance with an embodiment of the disclosure.
Figure 20:
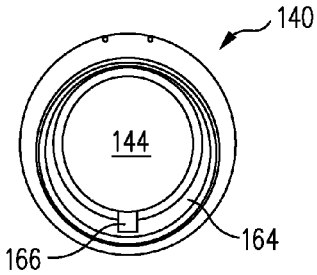
FIG. 20 is a rear end elevation view of the back end member of the suppressor of FIG. 13, showing a slot at the rear end thereof in accordance with an embodiment of the disclosure.
Figure 21:
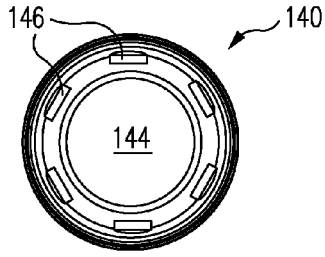
FIG. 21 is a front end elevation view of the back end member of the suppressor of FIG. 13 in accordance with an embodiment of the disclosure.
Figure 22:
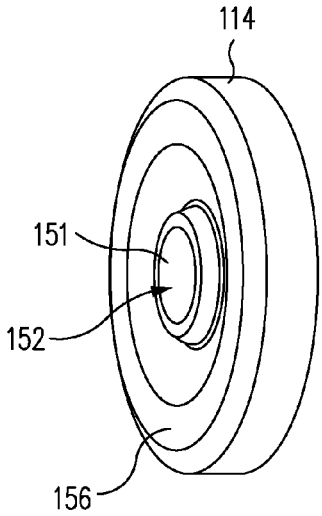
FIG. 22 is a front and left side perspective view of an example embodiment of a front end plate of the suppressor of FIG. 11A in accordance with an embodiment of the disclosure.
Figure 23:
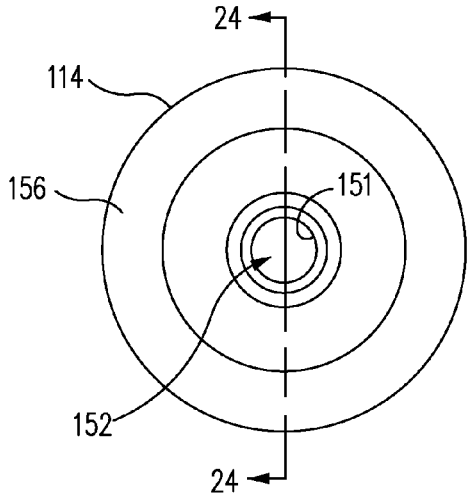
FIG. 23 is a front end elevation view of the front end plate of the suppressor of FIG. 11A in accordance with an embodiment of the disclosure.
Figure 24:
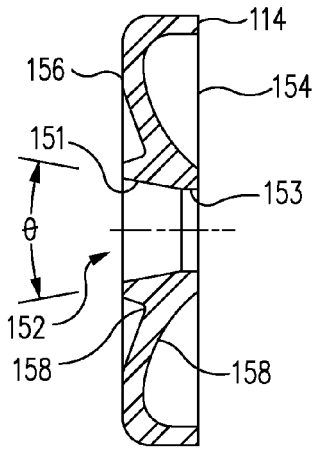
FIG. 24 is a cross-sectional view of the front end plate of the suppressor of FIG. 11A, as seen along the lines of the section 24-24 taken in FIG. 23 in accordance with an embodiment of the disclosure.
Figure 25:
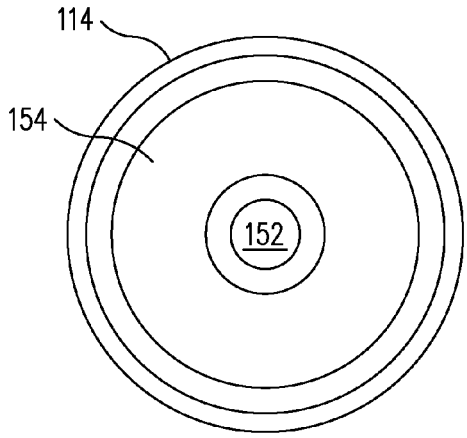
FIG. 25 is a rear end elevation view of the front end plate of the suppressor of FIG. 11A in accordance with an embodiment of the disclosure.
Figure 26:
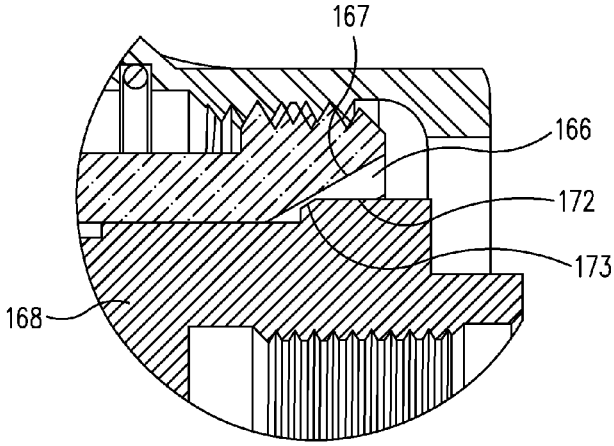
FIG. 26 is an enlarged partial detail view of an example embodiment of a complementary engagement between a mounting tab disposed on the adapter of FIG. 12 and a corresponding slot disposed in the back end member of the suppressor of FIG. 11A in accordance with an embodiment of the disclosure.
Figure 27:
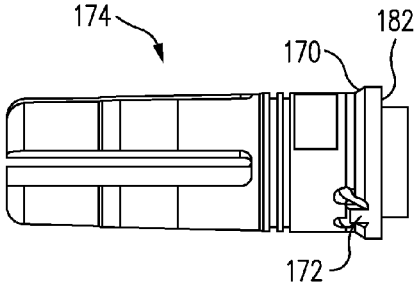
FIG. 27 is a left, lower side elevation view of an example embodiment of a flash hider, showing a ramped mounting tab disposed at a rear end circumfery thereof in accordance with an embodiment of the disclosure.
Figure 29:
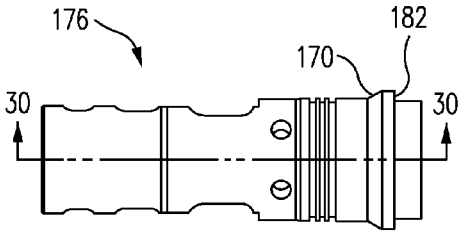
FIG. 29 is a left side elevation view of an example embodiment of a muzzle brake in accordance with an embodiment of the disclosure.
Figure 28:
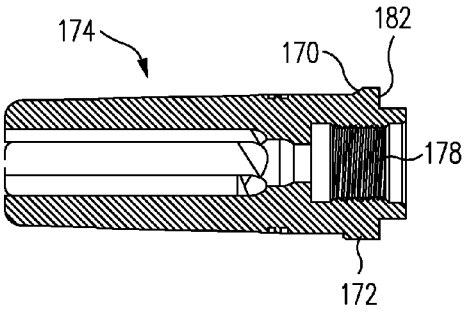
FIG. 28 is a cross-sectional view of the flash hider of FIG. 27 in accordance with an embodiment of the disclosure.
Figure 30:
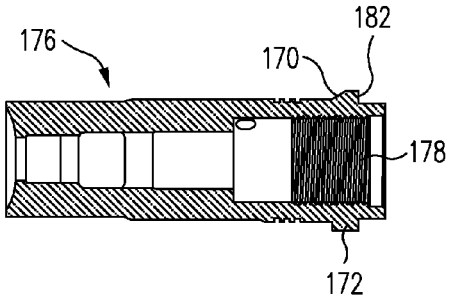
FIG. 30 is a cross-sectional view of the muzzle brake of FIG. 27, showing a mounting tab disposed at a rear end circumfery thereof in accordance with an embodiment of the disclosure.

In one embodiment, the blast deflector 148 may be a substantially tubular member (e.g., a continuous tubular ring or including one or more longitudinal splits 149 extending between front and rear ends of the blast deflector 148) implemented by a relatively thin sleeve having a longitudinal slit 149 (see FIG. 19) extending through its side wall to enable it to expand radially for ease of assembly to the back end member 140. In some embodiments, the blast deflector 148 may be attached to the back end member 140 (e.g., welded or brazed thereto) to hold the blast deflector 148 in place. In various embodiments, the housing 112, the back end member 140, and the blast deflector 148 can be fabricated efficiently from an alloy of aluminum or steel. Other configurations, assembly techniques, and/or materials can also be used where appropriate.

In other embodiments, any desired number of blast deflectors 148 may be positioned at other locations inside the housing 112 of the suppressor 100 (e.g., around various interior members such as back end member 140, one or more baffles 118, and/or other components). For example, a first blast deflector 148 may be provided at the back end member 140 of the suppressor 100 as shown, and one or more additional blast deflectors 148 may be provided to surround one or more baffles 118 located forward of the back end member for added protection for other portions of the housing 112 that are susceptible to receive hot gases (e.g., to prevent combustion gases passed through the interrupted central lumen 122 from impinging directly on the interior surface of the housing 112).

In other embodiments, the blast deflector 148 and/or similar structures may be used in other types of suppressors, e.g., those without a back end section 140 and/or blast suppression chamber(s) 142, such as the suppressor 10 or others. For example, in the suppressor 10, during a sustained, full automatic fire of the associated weapon 36 through the suppressor 10, a similar blast deflector may be provided to protect against extraordinary pressures and temperatures experienced in the gas expansion chambers 24 that might lead to a local failure or blowout of an affected area of the tubular housing 12. Such problems may be prevented in the suppressor 10 in a manner similar to that described above for the suppressor 100 by providing a blast deflector disposed concentrically within the housing 12 and about the affected portion of the baffles 18 that is operable to prevent hot gases flowing through the interrupted central lumen 22 and into successive ones of the gas expansion chambers 24 from impinging directly on the portion of the interior surface of the housing 12 surrounding the portion of the baffles 18 that are shielded by the blast deflector.

As discussed, it is common for the first round fired from a "cold" conventional suppressor (e.g., a suppressor that has not been recently fired) to exhibit a relatively large muzzle flash, while immediately succeeding rounds fired through the same suppressor typically do not exhibit as large a flash as that exhibited by the first round.

It has been determined by the inventor that this transient phenomenon results from circumstances where a suppressor through which a round has not been recently been fired is relatively "cool" and is filled with oxygen-rich ambient air. In this regard, the cold suppressor may be substantially at thermal equilibrium with its surrounding environment and its interior lumens and chambers are substantially filled with ambient air rather than combustion gases. When an initial round is then fired through the suppressor, the oxygen content of the gas between the inlet and outlet ends of the device is sufficient to sustain additional combustion of the oxygen within the length of the device itself, giving rise to a relatively large flash at the outlet end thereof. However, when subsequent rounds are then fired through the suppressor, the oxygen content of the gas in the device is relatively depleted and the interior lumens and chambers become substantially filled with combustion gases, such that the additional combustion of the oxygen within the device is no longer sustainable, and relatively smaller muzzle flashes are produced.

It has been further determined by the inventor that the heightened first round muzzle flash phenomenon discussed above can be substantially reduced or eliminated altogether by providing a suppressor with a front end plate 114 having a central bore 152 (e.g., a frusto-conical bore in one embodiment) extending therethrough and includes a taper that reduces the size of the first round muzzle flash by permitting additional ambient air to escape prior to combustion of the associated oxygen to reduce the overall size of the first round muzzle flash and/or by distributing the first round muzzle flash and at least some associated gases over a broader area when escaping the bore 152, thus reducing the length of the first round muzzle flash. Such an implementation can reduce the size and/or length of the first round muzzle flash and is particularly useful to reduce the detection (e.g., visual, thermal, and/or infrared imaging) of automatic weapons fired from hidden or obscured locations.

FIGS. 22-25 illustrate one example of the front end plate 114 which may be provided at the front end of the tubular housing 112 of the suppressor 100 (see FIGS. 11A-14). As may be seen in the cross-sectional view of FIG. 24, the bore 152 may be implemented with a tapered portion 151 and an untapered portion 153. The untapered portion 153 extends from a back surface 154 of the plate 114 to meet the tapered portion 151 within an interior of the plate 114. In one embodiment, the untapered portion 153 has a length of approximately 50 thousandths of an inch (e.g., 0.050 inches). The tapered portion 151 opens toward a front surface 156 of the plate 114, and has an included angle Θ. In various embodiments, included angle Θ may be implemented in a range of approximately 10 degrees to approximately 25 degrees. In one embodiment, included angle Θ is approximately 20 degrees. Other embodiments are also contemplated. For example, the untapered portion 153 may be implemented with different lengths and/or omitted altogether (e.g., the tapered portion 151 may extend entirely from the back surface 154 to the front surface 156 of the plate 114 in one embodiment).

Scallops 158 can be provided in the front and/or rear surfaces 156 and 154 to reduce weight. For example, scallops 158 can define recesses in the front surface and rear surfaces 156 and 154 of the plate 114, such recesses being disposed between an outer rim or lip of the plate 114 and a central portion of the plate 114 providing the bore 152. In the particular example embodiment illustrated in the figures, the front end of the bore 152 is substantially flush with the front surface 156 of the plate 114, but other configurations are also contemplated.

Figure 31:
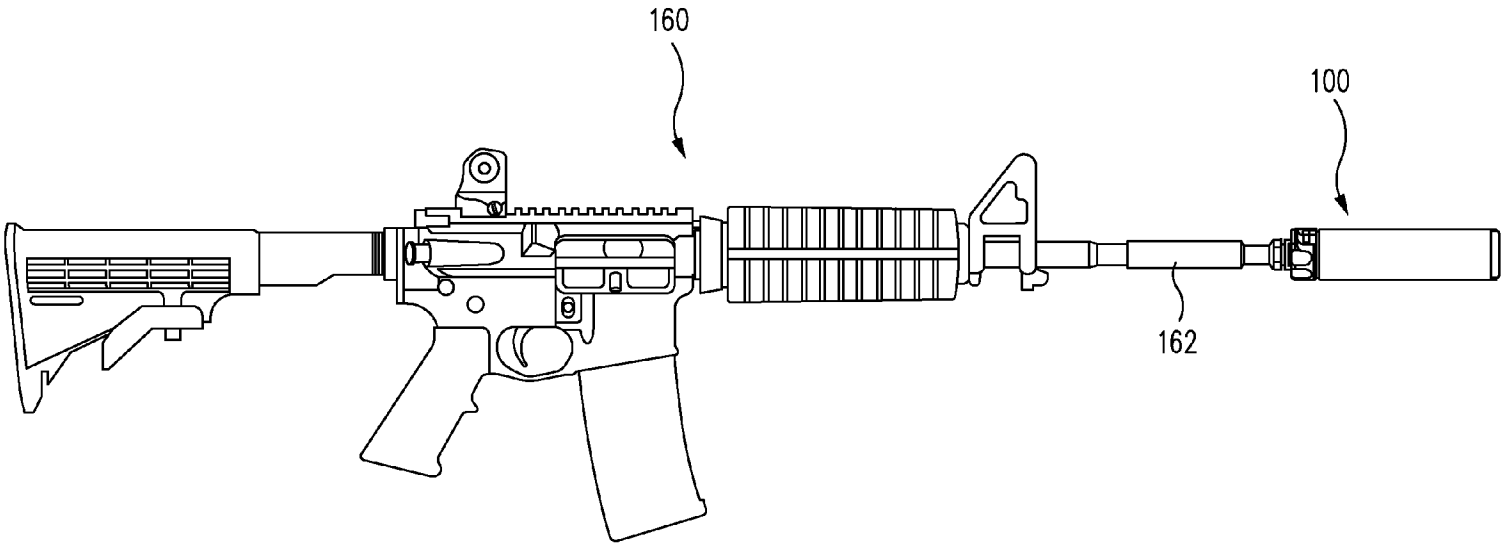
FIG. 31 is a right side elevation view of the suppressor of FIG. 11A, shown coupled to the muzzle end of a barrel of a rifle in accordance with an embodiment of the disclosure.

FIG. 31 illustrates the suppressor 100 coupled to an associated firearm 160, and in particular, to the muzzle end of a barrel 162 thereof. In the particular embodiment illustrated in FIG. 31, the associated weapon 160 comprises a rifle, viz., an M4 carbine, a variant of the standard M16A2 military assault rifle. However, as similarly discussed herein with regard to the suppressor 10, the suppressor 100 can also be used with firearms of different calibers and different types, such as semiautomatic or fully automatic machine pistols or rifles.

As discussed, certain existing sound suppressor mounting mechanisms utilize an internal pin arrangement that is subject to failure and deposit build-up. Such existing mechanisms may also require complex manufacturing techniques. In contrast, the suppressor 100 may be implemented using a slot-and-tab mounting mechanism. Such an arrangement may be used to reliably mount the suppressor 100 to a firearm, such as the firearm 160 or others, such that the central lumen 122 of the suppressor 100 is coaxially aligned with the central lumen (not illustrated) of the firearm's barrel 162, and such that the suppressor 100 is rotationally oriented (e.g., aligned) at a specific angular position relative thereto. Such an arrangement may also reduce the likelihood of problematic build-up of deposits and internal pin breakage over various existing mounting mechanisms.

As illustrated in FIGS. 12-13, the back end member 140 may be disposed in a rear section of the suppressor 100, as described above. As further shown in FIGS. 12, 17-18, 20, and 26, the back end member 140 includes a socket 164 having an interior surface with a tapered forwardly extending slot 166 (e.g., an index ramp) disposed therein. The interior surface of socket 164 is configured to receive a frusto-conical external surface of the adapter 168 in a complementary slide-in engagement.

The adapter 168 includes a plug 170 extending forwardly from a rear portion of a body thereof. The plug 170 has a frusto-conical external surface with a longitudinal alignment tab 172 extending forwardly therefrom such that as the front portion of the body of the plug 170 is inserted (e.g., slid) into the socket 164 followed by the rear portion of the body, the tab is received by slot 166 and the plug 170 contacts the interior surface of the socket. The engagement of tab 172 with slot 166 may thus rotationally align the suppressor 100 relative to a firearm. In addition, the complementary frusto-conical external surface of the plug 170 and the corresponding portion of the interior surface of the socket 164 permits plug 170 to be easily inserted into the socket 164 and reliably mate therewith. As illustrated in, e.g., the enlarged partial cross-sectional detail view of FIG. 26, a front end 173 of the tab 172 and a floor 167 of the slot 166 are correspondingly chamfered for ease of insertion of the former into the latter.

Advantageously, the slot 166 and the tab 172 (when engaged with the slot 166) are positioned substantially near the rearmost portion of the back end member 140 (e.g., on the end of the socket 164 thereof). As a result, the slot 166 and the tab 172 may be subject to less deposit build-up in comparison with prior suppressor mounting techniques that position various mounting engagement features substantially deeper within such prior suppressors. Also, because the tab 172 is provided on an external adapter (e.g., on a flash hider, muzzle brake, or other appropriate adapter), inadvertent damage sustained by the tab 172 (e.g., breakage, cracking, deformation, or other) does not prevent further usage of the suppressor 100 with another undamaged adapter.

The features described with regard to adapter 168 may be implemented in other types of adapters as may be desired for various implementations. For example, FIGS. 27-30 illustrate various other adapters such as another flash hider 174 (FIGS. 27-28) and a muzzle brake 176 (FIGS. 29-30) that may be implemented in accordance with the described slot-and-tab mounting mechanism to attach the suppressor 100 to the firearm 160.

The length of the tab 172 may also vary in different embodiments. For example, in flash hiders 168 and 174, a long embodiment of the tab 172 is provided wherein the front end of the tab 172 extends forward of the front end of the frusto-conical surface of the plug 170. In muzzle brake 176, a short embodiment of the tab 172 is provided wherein the front end of the tab 172 is substantially conterminous with a front end of the frusto-conical surface of the plug 170. Long and short embodiments of the tab 172 may be provided on any desired type of adapter, such as flash hiders, muzzle brakes, or others.

In one embodiment, the plug 170 and the alignment tab 172 may be formed, for example, by a machining operation directly into the muzzle end of the barrel 162 of the firearm 160, thereby eliminating the need for a separate adapter to mount the suppressor 100 to the firearm 160.

Where a separate adapter is used (e.g., such as flash hiders 168 or 174, or muzzle brake 176), a mechanism may be provided for removably coupling the adapter to the barrel 162 of the firearm 160. As illustrated in, e.g., the cross-sectional views of FIGS. 12, 28, and 30, in one example embodiment, this coupling mechanism can comprise a bore 178 extending into the rear end of the adapter, the bore 178 having an internal thread configured to engage a complementary external thread (not illustrated) disposed on the muzzle end of the barrel 162 of the firearm 160.

Additionally, a mechanism may be provided for retaining the back end member 140 in engagement with the adapter. For example, such a retaining mechanism may be implemented as described in U.S. Pat. Nos. 6,948,415, 7,676,976, and 7,946,069, all of which are incorporated by reference herein in their entirety. In this regard, an eccentric locking collar 180 may be rotatably disposed on the rear end of the back end member 140 and configured to engage with an opposing circumferential shoulder 182 disposed on the adapter as illustrated in FIGS. 10 and 12.

Thus, in one embodiment, a method may be performed for coupling the suppressor 100 to the muzzle end of the barrel 162 of the firearm 160 such that a central lumen 122 of the suppressor 100 is coaxially aligned with the central lumen of the barrel 162. Such a method may include coupling an adapter to the muzzle end of the barrel 162 of the firearm 160, as described above, sliding the back end member 140 into engagement with the adapter such that the external frusto-conical surface of the plug 170 is engaged in the corresponding internal frusto-conical surface of the socket 164 of the back end member 140, and engaging the alignment tab 172 in the slot 166. The retaining mechanism 180 can then be used to releasably secure the back end member 140 in engagement with the adapter.

Although various features have been described with regard to particular suppressors 10 and 100, it is contemplated that any of these features may be combined with each other in suppressors 10 and 100, or other suppressors as may be appropriate in particular implementations.

As those of some skill in this art will by now appreciate, and depending on the particular application at hand, many modifications, substitutions and variations can be made in and to the materials, apparatus, configurations and methods of use and production of the firearm sound suppressors of the present disclosure without departing from the spirit and scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

What is claimed is:

1. A method of aligning a firearm sound suppressor, the method comprising:

inserting a front portion of a body of an adapter into a socket of the firearm sound suppressor;

sliding a tab of the adapter into a slot disposed in an interior surface of the socket to rotationally align the firearm sound suppressor relative to a firearm; and contacting a plug of the adapter against the interior surface in a complementary engagement, wherein the plug is provided by a frusta-conical external surface of a rear portion of the body, wherein the tab extends longitudinally along the adapter from the plug, wherein the slot extends longitudinally along the firearm sound suppressor and tapers from a maximum depth at a rear aperture of the socket to a minimum depth within the socket.

2. The method of claim 1, wherein:

the socket is provided by a back end member disposed substantially within a housing of the firearm sound suppressor so as to define a blast suppression chamber between an exterior surface of the back end member and an interior surface of the housing; and the back end member comprises a lumen and a plurality of vents extending through the back end member between the lumen and the blast suppression chamber, wherein the vents are adapted to pass combustion gasses from the lumen to the chamber.

3. The method of claim 1, wherein a front end of the tab is substantially conterminous with a front end of the frusto-conical surface.

4. The method of claim 1, wherein a front end of the tab extends forward of a front end of the frusto-conical surface.

5. The method claim 1, wherein a front end of the tab and a floor of the slot are correspondingly chamfered.

6. The method of claim 1, wherein the adapter is a flash hider or a muzzle brake configured to mount on a muzzle end of a barrel of the firearm.

7. The method of claim 1, wherein the adapter is a muzzle end of a barrel of the firearm.

8. An adapter, comprising:

a body having a front portion configured to be inserted into a socket of a firearm sound suppressor;

a frusto-conical external surface substantially at a rear portion of the body and providing a plug configured to be received by a complementary interior surface of the socket; and a tab extending longitudinally along the adapter from the plug and adapted to be received by a slot extending longitudinally along the firearm sound suppressor and disposed in the interior surface to rotationally align the firearm sound suppressor relative to a firearm, wherein the slot tapers from a maximum depth at a rear aperture of the socket to a minimum depth within the socket.

9. The adapter of claim 8, wherein a front end of the tab is substantially conterminous with a front end of the frusto-conical surface.

10. The adapter of claim 8, wherein a front end of the tab extends forward of a front end of the frusto-conical surface.

11. The adapter claim 8, wherein a front end of the tab is chamfered.

12. The adapter of claim 8, wherein the adapter is a flash hider or a muzzle brake configured to mount on a muzzle end of a barrel of the firearm.

13. The adapter of claim 8, wherein the adapter is a muzzle end of a barrel of the firearm.

14. A firearm sound suppressor, comprising:

a housing; and a socket disposed in a rear section of the housing and configured to receive a front portion of a body of an adapter, wherein the socket comprises an interior surface configured to receive a plug in a complementary engagement, wherein the plug is provided by a frusto-conical external surface of a rear portion of the body, wherein a slot disposed in the interior surface is adapted to receive a tab of the adapter to rotationally align the firearm sound suppressor relative to a firearm, wherein the tab extends longitudinally along the adapter from the plug, wherein the slot extends longitudinally along the firearm sound suppressor and tapers from a maximum depth at a rear end of the socket to a minimum depth within the socket.

15. The firearm sound suppressor of claim 14, wherein a floor of the slot is chamfered.

16. The firearm sound suppressor of claim 14, wherein:

the socket is provided by a back end member disposed substantially within the housing so as to define a blast suppression chamber between an exterior surface of the back end member and an interior surface of the housing; and the back end member comprises a lumen and a plurality of vents extending through the back end member between the lumen and the blast suppression chamber, wherein the vents are adapted to pass combustion gasses from the lumen to the chamber.

* * * * *